US010610746B2

(12) United States Patent
Larson et al.

(10) Patent No.: US 10,610,746 B2
(45) Date of Patent: Apr. 7, 2020

(54) GOLF CLUB HEADS OR OTHER BALL STRIKING DEVICES HAVING DISTRIBUTED IMPACT RESPONSE

(71) Applicant: NIKE, Inc., Beaverton, OR (US)

(72) Inventors: Eric A. Larson, Fort Worth, TX (US); Robert M. Boyd, Double Oak, TX (US); Kenneth W. Brown, Tolland, CT (US); Martin Brouillette, Sherbrooke (CA); Chris Scott Daniels, Columbus, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/918,735

(22) Filed: Mar. 12, 2018

(65) Prior Publication Data

US 2018/0361209 A1 Dec. 20, 2018

Related U.S. Application Data

(63) Continuation of application No. 14/809,970, filed on Jul. 27, 2015, now Pat. No. 9,914,025, which is a (Continued)

(51) Int. Cl.
*A63B 53/04* (2015.01)
*A63B 60/54* (2015.01)
(Continued)

(52) U.S. Cl.
CPC ..... *A63B 53/0466* (2013.01); *A63B 60/54* (2015.10); *A63B 53/047* (2013.01);
(Continued)

(58) Field of Classification Search
USPC ..... 473/324–350
See application file for complete search history.

(56) References Cited

U.S. PATENT DOCUMENTS 569,438 A 10/1896 Urquhart
632,885 A 9/1899 Sweny
(Continued)

FOREIGN PATENT DOCUMENTS

CA 2139690 A1 7/1996
CN 2411030 Y 12/2000
(Continued)

OTHER PUBLICATIONS

Aug. 24, 2012—(WO) International Search Report and Written Opinion—App. PCT/US12/35476.
(Continued)

*Primary Examiner* — Alvin A Hunter
(74) *Attorney, Agent, or Firm* — Banner & Witcoff, Ltd.

(57) ABSTRACT

A ball striking device, such as a golf club head, includes a face having a ball striking surface configured for striking a ball and a body connected to the face and extending rearwardly from the face. The body has an impact-influencing structure in the form of a channel positioned on at least one surface of the body. A majority of a force generated by impact with a ball is absorbed by the impact-influencing structure, and a majority of a response force generated by the head upon impact with the ball is generated by the impact-influencing structure. The face may have increased stiffness as compared to existing faces, and may include a stiffening structure to create the increased stiffness, such as a porous or cellular stiffening structure.

17 Claims, 26 Drawing Sheets

Related U.S. Application Data continuation of application No. 13/308,036, filed on Nov. 30, 2011, now Pat. No. 9,089,747.

(60) Provisional application No. 61/541,767, filed on Sep. 30, 2011, provisional application No. 61/418,240, filed on Nov. 30, 2010.

(51) Int. Cl.
*A63B 60/52* (2015.01)
*A63B 60/00* (2015.01)

(52) U.S. Cl.
CPC ..... *A63B 53/0487* (2013.01); *A63B 60/52* (2015.10); *A63B 2053/042* (2013.01); *A63B 2053/045* (2013.01); *A63B 2053/0416* (2013.01); *A63B 2053/0425* (2013.01); *A63B 2053/0433* (2013.01); *A63B 2053/0437* (2013.01); *A63B 2060/002* (2015.10); *A63B 2209/02* (2013.01); *A63B 2225/01* (2013.01)

(56) References Cited

U.S. PATENT DOCUMENTS 648,256 A 4/1900 Hartley
777,400 A 12/1904 Clark
1,133,129 A 3/1915 Govan
1,222,770 A 4/1917 Kaye
1,705,997 A * 3/1929 Williams ..... A63B 53/04 473/329
1,840,924 A 1/1932 Tucker
1,854,548 A 4/1932 Hunt
1,916,792 A 7/1933 Hadden
2,004,968 A 6/1935 Young
2,041,676 A 5/1936 Gallagher
2,087,685 A * 7/1937 Hackney ..... A63B 53/04 473/349
2,429,351 A 10/1947 Fetterolf
2,550,846 A 5/1951 Milligan
2,750,194 A 6/1956 Clark
3,061,310 A 10/1962 Giza
3,064,980 A 11/1962 Steiner
3,084,940 A 4/1963 Cissel
3,212,783 A 10/1965 Bradley
3,519,271 A 7/1970 Smith
3,606,327 A 9/1971 Gorman
3,810,631 A 5/1974 Braly
3,814,437 A 6/1974 Winquist
3,966,210 A 6/1976 Rozmus
3,970,236 A 7/1976 Rogers
3,976,299 A 8/1976 Lawrence et al.
3,980,301 A 9/1976 Smith
3,997,170 A 12/1976 Goldberg
4,194,739 A 3/1980 Thompson
4,313,607 A 2/1982 Thompson
4,322,083 A 3/1982 Imai
4,398,965 A * 8/1983 Campau ..... A63B 53/04 148/522
4,431,192 A 2/1984 Stuff, Jr.
4,438,931 A 3/1984 Motomiya
4,444,392 A 4/1984 Duclos
4,511,145 A 4/1985 Schmidt
4,523,759 A 6/1985 Igarashi
4,534,558 A 8/1985 Yoneyama
4,535,990 A 8/1985 Yamada
4,582,321 A 4/1986 Yoneyama
4,630,827 A 12/1986 Yoneyama
4,635,941 A 1/1987 Yoneyama
4,664,383 A 5/1987 Aizawa
4,667,963 A 5/1987 Yoneyama
4,681,321 A 7/1987 Chen et al.
4,697,814 A 10/1987 Yamada
4,708,347 A 11/1987 Kobayashi
4,728,105 A 3/1988 Kobayashi
4,732,389 A 3/1988 Kobayashi
4,811,949 A 3/1989 Kobayashi
4,811,950 A 3/1989 Kobayashi
4,842,280 A 6/1989 Hilton
4,867,458 A 9/1989 Sumikawa et al.
4,871,174 A 10/1989 Kobayashi
4,895,371 A 1/1990 Bushner
4,898,387 A 2/1990 Finney
4,927,144 A 5/1990 Stormon
4,928,972 A 5/1990 Nakanishi et al.
4,930,781 A * 6/1990 Allen ..... A63B 53/04 473/346
5,004,242 A 4/1991 Iwanaga et al.
5,009,425 A 4/1991 Okumoto et al.
D318,703 S 7/1991 Shearer
5,028,049 A 7/1991 McKeighen
5,060,951 A * 10/1991 Allen ..... A63B 53/04 473/346
5,067,715 A 11/1991 Schmidt et al.
5,076,585 A * 12/1991 Bouquet ..... A63B 53/04 473/343
5,078,397 A 1/1992 Aizawa
5,080,366 A 1/1992 Okumoto et al.
D326,130 S 5/1992 Chorne
5,149,091 A 9/1992 Okumoto et al.
5,186,465 A 2/1993 Chorne
5,205,560 A 4/1993 Hoshi et al.
5,211,401 A 5/1993 Hainey
5,213,328 A 5/1993 Long et al.
5,221,086 A * 6/1993 Antonious ..... A63B 53/04 473/327
5,228,694 A 7/1993 Okumoto et al.
5,269,517 A 12/1993 Petruccelli et al.
5,282,625 A * 2/1994 Schmidt ..... A63B 53/04 473/350
5,290,036 A 3/1994 Fenton et al.
5,295,689 A 3/1994 Lundberg
5,301,941 A * 4/1994 Allen ..... A63B 53/0466 164/34
5,301,946 A * 4/1994 Schmidt ..... A63B 53/04 473/290
5,316,305 A 5/1994 McCabe
5,326,106 A 7/1994 Meyer
5,330,187 A * 7/1994 Schmidt ..... A63B 53/04 473/291
D350,176 S 8/1994 Antonious
5,333,871 A 8/1994 Wishon
5,340,104 A 8/1994 Griffin
D354,103 S 1/1995 Allen
5,377,985 A 1/1995 Ohnishi
5,380,010 A 1/1995 Werner et al.
5,407,196 A 4/1995 Busnardo
5,411,263 A 5/1995 Schmidt et al.
5,413,337 A 5/1995 Goodman et al.
5,419,556 A 5/1995 Take
5,419,560 A 5/1995 Bamber
5,435,551 A 7/1995 Chen
5,437,456 A * 8/1995 Schmidt ..... A63B 53/04 473/291
5,447,307 A 9/1995 Antonious
5,451,056 A 9/1995 Manning
5,451,058 A 9/1995 Price et al.
D363,749 S 10/1995 Kenmi
5,464,211 A 11/1995 Atkins, Sr.
5,464,217 A 11/1995 Shenoha et al.
5,467,988 A 11/1995 Henwood
5,472,201 A * 12/1995 Aizawa ..... A63B 53/04 473/329
5,472,203 A * 12/1995 Schmidt ..... A63B 53/04 473/350
5,480,152 A 1/1996 Schmidt et al.
5,484,155 A * 1/1996 Yamawaki ..... A63B 53/04 473/242
5,489,097 A 2/1996 Simmons
5,492,327 A * 2/1996 Biafore, Jr. ..... A63B 53/04 473/332
5,497,995 A 3/1996 Swisshelm

(56) References Cited

U.S. PATENT DOCUMENTS 5,505,453 A * 4/1996 Mack ..... A63B 53/04 473/329
5,516,106 A 5/1996 Henwood
5,518,243 A 5/1996 Redman
D371,817 S 7/1996 Olsavsky et al.
D372,063 S 7/1996 Hueber
5,531,439 A 7/1996 Azzarella
5,533,725 A 7/1996 Reynolds, Jr.
5,533,728 A 7/1996 Pehoski et al.
5,547,188 A * 8/1996 Dumontier ..... A63B 53/04 473/287
5,547,427 A 8/1996 Rigal et al.
5,564,705 A 10/1996 Kobayashi et al.
D375,987 S 11/1996 Lin
5,570,886 A 11/1996 Rigal et al.
5,586,947 A 12/1996 Rutin
5,586,948 A 12/1996 Mick
5,595,552 A 1/1997 Wright et al.
5,601,498 A 2/1997 Antonious
5,603,668 A 2/1997 Antonious
5,607,365 A 3/1997 Wolf
5,616,088 A 4/1997 Aizawa et al.
5,626,528 A 5/1997 Toulon
5,626,530 A 5/1997 Schmidt et al.
D381,382 S 7/1997 Fenton, Jr.
5,643,107 A * 7/1997 Gorman ..... A63B 53/04 473/328
5,669,829 A 9/1997 Lin
D386,550 S 11/1997 Wright et al.
D386,551 S 11/1997 Solheim et al.
D387,113 S 12/1997 Burrows
D387,405 S 12/1997 Solheim et al.
5,692,972 A 12/1997 Langslet
5,695,409 A 12/1997 Jackson
5,709,615 A 1/1998 Liang
5,711,722 A 1/1998 Miyajima et al.
D392,007 S 3/1998 Fox
5,735,754 A 4/1998 Antonious
5,746,664 A 5/1998 Reynolds, Jr.
5,749,795 A * 5/1998 Schmidt ..... A63B 53/04 473/350
5,766,094 A * 6/1998 Mahaffey ..... A63B 53/04 473/342
5,772,525 A 6/1998 Klein
5,785,609 A 7/1998 Sheets et al.
D397,387 S 8/1998 Allen
5,788,584 A 8/1998 Parente et al.
5,797,807 A * 8/1998 Moore ..... A63B 53/04 473/345
D398,687 S 9/1998 Miyajima et al.
D398,946 S 9/1998 Kenmi
5,803,830 A 9/1998 Austin et al.
D399,274 S 10/1998 Bradford
5,820,481 A 10/1998 Raudman
D400,945 S 11/1998 Gilbert et al.
5,839,975 A 11/1998 Lundberg
5,851,159 A * 12/1998 Burrows ..... A63B 53/04 473/345
5,851,160 A * 12/1998 Rugge ..... A63B 53/04 473/349
5,863,261 A * 1/1999 Eggiman ..... A63B 53/04 473/329
5,873,791 A * 2/1999 Allen ..... A63B 53/04 473/309
5,888,148 A 3/1999 Allen
5,908,356 A 6/1999 Nagamoto
5,908,357 A 6/1999 Hsieh
5,941,782 A 8/1999 Cook
D414,234 S 9/1999 Darrah
5,947,841 A 9/1999 Silvestro
5,971,868 A 10/1999 Kosmatka
5,997,415 A 12/1999 Wood
6,001,030 A 12/1999 Delaney
6,007,432 A 12/1999 Kosmatka
6,015,354 A 1/2000 Ahn et al.
6,027,416 A * 2/2000 Schmidt ..... A63B 53/04 473/345
D422,041 S 3/2000 Bradford
6,042,486 A * 3/2000 Gallagher ..... A63B 53/0475 473/329
6,048,278 A 4/2000 Meyer et al.
6,074,309 A * 6/2000 Mahaffey ..... A63B 53/04 473/342
6,080,068 A 6/2000 Takeda
6,086,485 A 7/2000 Hamada et al.
6,095,931 A 8/2000 Hettinger et al.
6,117,022 A 9/2000 Crawford et al.
RE36,950 E * 11/2000 Allen ..... A63B 53/0466 164/34
6,149,533 A 11/2000 Finn
6,149,534 A 11/2000 Peters et al.
6,159,109 A 12/2000 Langslet
6,176,791 B1 1/2001 Wright
6,179,726 B1 * 1/2001 Satoh ..... A63B 53/04 473/290
6,193,614 B1 2/2001 Sasamoto et al.
6,203,449 B1 3/2001 Kenmi
6,217,461 B1 4/2001 Galy
6,270,423 B1 8/2001 Webb
6,299,546 B1 10/2001 Wang
6,302,807 B1 10/2001 Rohrer
6,319,149 B1 11/2001 Lee
6,319,150 B1 11/2001 Werner et al.
6,332,848 B1 * 12/2001 Long ..... A63B 53/04 473/328
6,338,683 B1 * 1/2002 Kosmatka ..... A63B 53/04 473/329
6,342,018 B1 * 1/2002 Mason ..... A63B 53/04 473/252
6,344,000 B1 2/2002 Hamada et al.
6,344,001 B1 2/2002 Hamada et al.
6,348,013 B1 * 2/2002 Kosmatka ..... A63B 53/04 473/329
6,354,956 B1 * 3/2002 Doong ..... A63B 53/0466 473/219
6,354,961 B1 3/2002 Allen
RE37,647 E 4/2002 Wolf
6,368,234 B1 4/2002 Galloway
6,386,987 B1 5/2002 Lejeune, Jr.
6,390,933 B1 5/2002 Galloway et al.
6,398,666 B1 6/2002 Evans et al.
6,402,637 B1 6/2002 Sasamoto et al.
6,402,638 B1 6/2002 Kelley
6,422,951 B1 7/2002 Burrows
6,428,423 B1 8/2002 Merko
6,435,982 B1 8/2002 Galloway et al.
6,443,857 B1 9/2002 Chuang
6,447,405 B1 9/2002 Chen
6,454,665 B2 9/2002 Antonious
6,471,603 B1 10/2002 Kosmatka
D465,251 S 11/2002 Wood et al.
6,475,100 B1 11/2002 Helmstetter et al.
6,478,690 B2 11/2002 Helmstetter et al.
6,482,107 B1 11/2002 Urbanski et al.
6,506,129 B2 1/2003 Chen
6,524,197 B2 2/2003 Boone
6,524,198 B2 2/2003 Takeda
6,533,679 B1 3/2003 McCabe et al.
6,551,199 B2 4/2003 Viera
6,558,271 B1 5/2003 Beach et al.
6,602,149 B1 8/2003 Jacobson
6,605,007 B1 * 8/2003 Bissonnette ..... A63B 53/0466 473/329
6,607,451 B2 * 8/2003 Kosmatka ..... A63B 53/04 473/329
6,616,547 B2 9/2003 Vincent et al.
D482,089 S 11/2003 Burrows
D482,090 S 11/2003 Burrows
D482,420 S 11/2003 Burrows
6,641,490 B2 11/2003 Ellemor
6,652,390 B2 11/2003 Bradford
6,652,391 B1 11/2003 Kubica et al.

(56) References Cited

U.S. PATENT DOCUMENTS

D484,208 S 12/2003 Burrows
6,663,503 B1 12/2003 Kenmi
6,669,577 B1 * 12/2003 Hocknell ..... A63B 53/0466 473/329
6,676,533 B1 1/2004 Hsien
6,688,989 B2 2/2004 Best
6,695,715 B1 2/2004 Chikaraishi
6,719,641 B2 4/2004 Dabbs et al.
6,719,645 B2 * 4/2004 Kouno ..... A63B 53/04 473/345
6,739,983 B2 5/2004 Helmstetter et al.
6,743,112 B2 6/2004 Nelson
6,773,360 B2 8/2004 Willett et al.
6,780,123 B2 8/2004 Hasebe
6,800,037 B2 * 10/2004 Kosmatka ..... A63B 53/04 473/329
6,800,038 B2 10/2004 Willett et al.
6,800,039 B1 10/2004 Tseng
D498,508 S 11/2004 Antonious
6,811,496 B2 11/2004 Wahl et al.
D501,036 S 1/2005 Burrows
6,840,872 B2 1/2005 Yoneyama
D502,232 S 2/2005 Antonious
6,863,620 B2 * 3/2005 Tucker, Sr. ..... A63B 53/0487 473/288
6,880,222 B2 4/2005 Matsunaga
6,887,165 B2 5/2005 Tsurumaki
6,899,638 B2 5/2005 Iwata et al.
6,923,733 B2 8/2005 Chen
6,926,618 B2 8/2005 Sanchez et al.
6,960,142 B2 11/2005 Bissonnette et al.
6,979,270 B1 * 12/2005 Allen ..... A63B 53/04 473/290
6,986,715 B2 * 1/2006 Mahaffey ..... A63B 53/04 473/305
6,991,560 B2 1/2006 Tseng
D515,642 S 2/2006 Antonious
6,994,635 B2 2/2006 Poynor
7,018,303 B2 3/2006 Yamamoto
7,018,304 B2 3/2006 Bradford
7,025,692 B2 * 4/2006 Erickson ..... A63B 53/0466 473/335
7,041,003 B2 5/2006 Bissonnette et al.
7,048,646 B2 5/2006 Yamanaka et al.
D523,498 S 6/2006 Chen et al.
7,056,229 B2 6/2006 Chen
7,066,835 B2 6/2006 Evans et al.
D524,392 S 7/2006 Madore et al.
7,070,513 B2 * 7/2006 Takeda ..... A63B 53/04 473/329
7,070,515 B1 7/2006 Liu
7,077,762 B2 * 7/2006 Kouno ..... A63B 53/0466 473/314
7,083,530 B2 8/2006 Wahl et al.
7,086,964 B2 8/2006 Chen et al.
7,090,590 B2 8/2006 Chen
7,101,289 B2 * 9/2006 Gibbs ..... A63B 53/02 473/329
7,121,956 B2 10/2006 Lo
7,128,660 B2 10/2006 Gillig
7,128,663 B2 10/2006 Bamber
7,134,971 B2 11/2006 Franklin et al.
7,137,907 B2 11/2006 Gibbs et al.
7,140,975 B2 11/2006 Bissonnette et al.
7,140,977 B2 11/2006 Atkins, Sr.
7,156,750 B2 1/2007 Nishitani et al.
7,163,468 B2 1/2007 Gibbs et al.
7,163,470 B2 1/2007 Galloway et al.
7,169,059 B2 1/2007 Rice et al.
7,175,541 B2 2/2007 Lo
7,186,185 B2 3/2007 Nagy
7,186,188 B2 3/2007 Gilbert et al.
7,192,364 B2 3/2007 Long
7,201,668 B1 4/2007 Pamias
7,207,898 B2 4/2007 Rice et al.
7,211,006 B2 * 5/2007 Chang ..... A63B 53/04 473/329
7,226,366 B2 * 6/2007 Galloway ..... A63B 53/0466 473/332
7,241,230 B2 * 7/2007 Tsunoda ..... A63B 53/04 473/324
7,244,189 B1 7/2007 Stobbe
7,247,104 B2 7/2007 Poynor
7,255,653 B2 8/2007 Saso
7,258,631 B2 8/2007 Galloway et al.
7,261,643 B2 8/2007 Rice et al.
D551,310 S 9/2007 Kuan et al.
D552,701 S 10/2007 Ruggiero et al.
7,278,926 B2 10/2007 Frame
7,294,064 B2 * 11/2007 Tsurumaki ..... A63B 53/0466 473/329
7,297,071 B2 11/2007 Hyman
7,297,073 B2 11/2007 Jung
7,306,527 B2 * 12/2007 Williams ..... A63B 53/02 473/329
7,335,112 B1 2/2008 Bitondo
D566,214 S 4/2008 Evans et al.
7,351,161 B2 4/2008 Beach
7,367,898 B2 * 5/2008 Hawkins ..... A41D 13/015 473/329
7,387,579 B2 * 6/2008 Lin ..... A63B 53/04 473/332
7,396,289 B2 7/2008 Soracco et al.
7,396,293 B2 7/2008 Soracco
7,396,296 B2 7/2008 Evans
7,407,443 B2 8/2008 Franklin et al.
7,407,448 B2 * 8/2008 Stevens ..... A63B 53/02 473/329
7,431,663 B2 10/2008 Pamias
7,435,189 B2 10/2008 Hirano
7,442,132 B2 10/2008 Nishio
7,445,563 B1 * 11/2008 Werner ..... A63B 53/0466 473/332
7,470,201 B2 12/2008 Nakahara et al.
7,473,186 B2 1/2009 Best et al.
7,476,161 B2 1/2009 Williams et al.
7,494,426 B2 2/2009 Nishio et al.
D588,223 S 3/2009 Kuan
7,500,924 B2 * 3/2009 Yokota ..... A63B 53/0466 473/332
7,520,820 B2 4/2009 Dimarco
7,530,901 B2 5/2009 Imamoto et al.
7,530,903 B2 5/2009 Imamoto et al.
7,540,810 B2 6/2009 Hettinger et al.
7,559,850 B2 7/2009 Gilbert et al.
7,563,176 B2 7/2009 Roberts et al.
7,572,193 B2 * 8/2009 Yokota ..... A63B 53/0466 473/328
7,575,523 B2 8/2009 Yokota
7,575,524 B2 8/2009 Willett et al.
7,582,024 B2 * 9/2009 Shear ..... A63B 53/0466 473/329
7,618,331 B2 11/2009 Hirano
7,621,820 B2 11/2009 Clausen et al.
7,632,193 B2 12/2009 Thielen
7,641,568 B2 1/2010 Hoffman et al.
7,641,569 B2 1/2010 Best et al.
7,651,409 B1 1/2010 Mier
7,713,138 B2 5/2010 Sato et al.
7,717,803 B2 5/2010 DiMarco
7,717,807 B2 5/2010 Evans et al.
7,722,478 B2 5/2010 Ebner
D619,666 S 7/2010 DePaul
7,749,101 B2 7/2010 Imamoto et al.
7,753,809 B2 7/2010 Cackett et al.
7,758,452 B2 7/2010 Soracco
7,771,290 B2 8/2010 Bezilla et al.
7,803,066 B2 9/2010 Solheim et al.
7,824,277 B2 11/2010 Bennett et al.
7,837,577 B2 11/2010 Evans
7,846,036 B2 12/2010 Tanaka
7,857,711 B2 12/2010 Shear

(56) References Cited

U.S. PATENT DOCUMENTS 7,867,105 B2 1/2011 Moon
7,871,336 B2 1/2011 Breier et al.
7,878,924 B2 2/2011 Clausen et al.
7,896,753 B2 3/2011 Boyd et al.
7,922,596 B2 4/2011 Vanderbilt et al.
7,922,603 B2 4/2011 Boyd et al.
7,927,231 B2 4/2011 Sato et al.
7,931,545 B2 4/2011 Soracco et al.
7,934,998 B2 5/2011 Yokota
7,935,003 B2 5/2011 Matsunaga et al.
7,938,739 B2 5/2011 Cole et al.
7,959,523 B2 6/2011 Rae et al.
7,967,699 B2 6/2011 Soracco
7,988,565 B2 8/2011 Abe
7,997,999 B2 8/2011 Roach et al.
8,007,371 B2 8/2011 Breier et al.
8,012,038 B1 * 9/2011 Beach ..... A63B 53/0466 473/329
8,012,041 B2 9/2011 Gibbs et al.
8,016,694 B2 9/2011 Llewellyn et al.
8,043,166 B2 10/2011 Cackett et al.
8,070,622 B2 12/2011 Schmidt
D659,781 S 5/2012 Oldknow
8,172,697 B2 * 5/2012 Cackett ..... A63B 53/0466 473/329
8,177,661 B2 5/2012 Beach et al.
8,177,664 B2 5/2012 Horii et al.
8,182,364 B2 5/2012 Cole et al.
8,187,116 B2 * 5/2012 Boyd ..... A63B 53/0466 473/329
8,206,241 B2 6/2012 Boyd et al.
D665,472 S 8/2012 McDonnell et al.
8,235,841 B2 8/2012 Stites et al.
8,235,844 B2 * 8/2012 Albertsen ..... A63B 53/0466 473/345
8,241,143 B2 * 8/2012 Albertsen ..... A63B 53/0466 473/345
8,241,144 B2 * 8/2012 Albertsen ..... A63B 53/0466 473/345
8,251,834 B2 * 8/2012 Curtis ..... A63B 53/0466 473/329
8,251,836 B2 8/2012 Brandt
8,257,195 B1 * 9/2012 Erickson ..... A63B 53/0466 473/329
8,257,196 B1 9/2012 Abbott et al.
8,272,974 B2 9/2012 Mickelson et al.
8,277,337 B2 10/2012 Shimazaki
8,282,506 B1 10/2012 Holt
8,303,434 B1 11/2012 DePaul
8,308,583 B2 11/2012 Morris et al.
8,328,659 B2 12/2012 Shear
8,337,319 B2 12/2012 Sargent et al.
8,337,325 B2 12/2012 Boyd et al.
8,353,782 B1 1/2013 Beach et al.
8,353,786 B2 * 1/2013 Beach ..... A63B 53/0466 473/345
8,360,900 B2 * 1/2013 Snyder ..... A63B 53/0466 473/327
D675,691 S 2/2013 Oldknow et al.
D675,692 S 2/2013 Oldknow et al.
D676,512 S 2/2013 Oldknow et al.
D676,909 S 2/2013 Oldknow et al.
D676,913 S 2/2013 Oldknow et al.
D676,914 S 2/2013 Oldknow et al.
D676,915 S 2/2013 Oldknow et al.
8,382,604 B2 2/2013 Billings
D677,353 S 3/2013 Oldknow et al.
D678,913 S 3/2013 Chu
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,403,771 B1 * 3/2013 Rice ..... A63B 53/04 473/328
D679,354 S 4/2013 Oldknow et al.
8,430,763 B2 * 4/2013 Beach ..... A63B 53/0466 473/307
8,430,764 B2 4/2013 Bennett et al.
8,435,134 B2 5/2013 Tang et al.
8,435,135 B2 5/2013 Stites et al.
D684,230 S 6/2013 Roberts et al.
8,491,416 B1 7/2013 Demille et al.
8,517,855 B2 8/2013 Beach et al.
8,517,860 B2 8/2013 Albertsen et al.
8,562,453 B2 10/2013 Sato
8,579,728 B2 * 11/2013 Morales ..... A63B 53/04 473/349
8,591,351 B2 11/2013 Albertsen et al.
8,591,352 B2 11/2013 Hirano
8,591,353 B1 * 11/2013 Honea ..... A63B 53/0466 473/345
8,608,587 B2 12/2013 Henrikson et al.
D697,152 S * 1/2014 Harbert ..... D21/752
8,628,433 B2 1/2014 Stites et al.
8,632,419 B2 1/2014 Tang et al.
8,641,555 B2 2/2014 Stites et al.
8,663,027 B2 * 3/2014 Morales ..... B23K 20/021 473/329
8,690,704 B2 4/2014 Thomas
8,696,491 B1 4/2014 Myers
8,702,531 B2 4/2014 Boyd et al.
8,734,265 B2 5/2014 Soracco
D707,768 S 6/2014 Oldknow et al.
D707,769 S 6/2014 Oldknow et al.
D707,773 S 6/2014 Oldknow et al.
8,758,153 B2 6/2014 Sargent et al.
D708,281 S 7/2014 Oldknow et al.
D709,575 S 7/2014 Oldknow et al.
8,821,312 B2 9/2014 Burnett et al.
8,827,831 B2 9/2014 Burnett et al.
8,827,836 B2 9/2014 Thomas
8,834,289 B2 9/2014 de la Cruz et al.
8,834,290 B2 9/2014 Bezilla et al.
8,845,454 B2 9/2014 Boyd et al.
D714,893 S 10/2014 Atwell
8,858,360 B2 10/2014 Rice et al.
8,870,679 B2 10/2014 Oldknow
8,888,607 B2 11/2014 Harbert et al.
D722,122 S 2/2015 Greensmith
D725,729 S 3/2015 Song
8,986,133 B2 * 3/2015 Bennett ..... A63B 53/06 473/329
D726,847 S 4/2015 Song
9,211,448 B2 * 12/2015 Bezilla ..... A63B 53/06
9,682,290 B2 * 6/2017 Shear ..... A63B 53/0466
9,694,255 B2 7/2017 Oldknow et al.
10,029,156 B2 * 7/2018 Yi ..... A63B 53/0466
10,029,161 B2 * 7/2018 Knutson ..... A63B 53/0466
10,086,241 B2 * 10/2018 Mizutani ..... A63B 60/52
10,099,092 B2 * 10/2018 Morin ..... A63B 53/047
2002/0019265 A1 * 2/2002 Allen ..... A63B 53/04 473/329
2002/0183134 A1 * 12/2002 Allen ..... A63B 53/04 473/329
2002/0189356 A1 12/2002 Bissonnette et al.
2003/0013545 A1 1/2003 Vincent et al.
2003/0045371 A1 3/2003 Wood et al.
2003/0054900 A1 3/2003 Tindale
2003/0087710 A1 5/2003 Sheets et al.
2003/0190975 A1 10/2003 Fagot
2003/0220154 A1 11/2003 Anelli
2004/0009829 A1 1/2004 Kapilow
2004/0018890 A1 1/2004 Stites et al.
2004/0023729 A1 2/2004 Nagai et al.
2004/0121852 A1 * 6/2004 Tsurumaki ..... A63B 53/0466 473/344
2004/0176183 A1 * 9/2004 Tsurumaki ..... A63B 53/0466 473/345

(56) References Cited

U.S. PATENT DOCUMENTS

2004/0180730 A1 9/2004 Franklin et al.
2004/0192463 A1* 9/2004 Tsurumaki ..... A63B 53/0466 473/329
2004/0219991 A1 11/2004 Suprock et al.
2005/0009630 A1* 1/2005 Chao ..... A63B 53/0466 473/342
2005/0032586 A1 2/2005 Willett et al.
2005/0049075 A1 3/2005 Chen et al.
2005/0070371 A1 3/2005 Chen et al.
2005/0096151 A1 5/2005 Hou et al.
2005/0101407 A1 5/2005 Hirano
2005/0119068 A1 6/2005 Onoda et al.
2005/0119070 A1 6/2005 Kumamoto
2005/0124435 A1 6/2005 Gambetta et al.
2005/0192118 A1 9/2005 Rice et al.
2005/0215350 A1 9/2005 Reyes et al.
2005/0227780 A1 10/2005 Cover et al.
2005/0227781 A1 10/2005 Huang et al.
2005/0266933 A1 12/2005 Galloway
2006/0000528 A1 1/2006 Galloway
2006/0019770 A1 1/2006 Meyer et al.
2006/0035718 A1 2/2006 Soracco et al.
2006/0040765 A1 2/2006 Sano
2006/0046868 A1 3/2006 Murphy
2006/0068932 A1 3/2006 Rice et al.
2006/0073908 A1 4/2006 Tavares et al.
2006/0073910 A1 4/2006 Imamoto et al.
2006/0079349 A1 4/2006 Rae et al.
2006/0084525 A1 4/2006 Imamoto et al.
2006/0094531 A1 5/2006 Bissonnette et al.
2006/0105857 A1 5/2006 Stark
2006/0111201 A1 5/2006 Nishio et al.
2006/0122004 A1 6/2006 Chen et al.
2006/0194644 A1 8/2006 Nishio
2006/0281582 A1 12/2006 Sugimoto
2007/0015601 A1 1/2007 Tsunoda et al.
2007/0021234 A1 1/2007 Tsurumaki et al.
2007/0026961 A1* 2/2007 Hou ..... A63B 53/0466 473/329
2007/0049400 A1 3/2007 Imamoto et al.
2007/0049407 A1 3/2007 Tateno et al.
2007/0049417 A1 3/2007 Shear
2007/0117648 A1 5/2007 Yokota
2007/0149309 A1 6/2007 Ford
2007/0155538 A1 7/2007 Rice et al.
2007/0225085 A1 9/2007 Koide et al.
2007/0238551 A1 10/2007 Yokota
2008/0015047 A1 1/2008 Rice et al.
2008/0032817 A1 2/2008 Lo
2008/0039228 A1 2/2008 Breier et al.
2008/0064523 A1 3/2008 Chen
2008/0076595 A1 3/2008 Lai et al.
2008/0125239 A1 5/2008 Clausen et al.
2008/0125244 A1 5/2008 Meyer et al.
2008/0125246 A1 5/2008 Matsunaga
2008/0139339 A1 6/2008 Cheng
2008/0146370 A1 6/2008 Beach et al.
2008/0182682 A1 7/2008 Rice et al.
2008/0248896 A1 10/2008 Hirano
2009/0062032 A1 3/2009 Boyd et al.
2009/0075751 A1 3/2009 Gilbert et al.
2009/0098949 A1 4/2009 Chen
2009/0124410 A1 5/2009 Rife
2009/0163294 A1 6/2009 Cackett et al.
2009/0264214 A1 10/2009 De La Cruz et al.
2009/0286611 A1 11/2009 Beach et al.
2009/0318245 A1 12/2009 Yim et al.
2010/0016095 A1 1/2010 Burnett et al.
2010/0029402 A1 2/2010 Noble et al.
2010/0035701 A1 2/2010 Kusumoto
2010/0048324 A1 2/2010 Wada et al.
2010/0056298 A1 3/2010 Jertson et al.
2010/0069171 A1 3/2010 Clausen et al.
2010/0093463 A1 4/2010 Davenport et al.
2010/0113176 A1 5/2010 Boyd et al.
2010/0113183 A1 5/2010 Soracco
2010/0113184 A1 5/2010 Kuan et al.
2010/0190573 A1 7/2010 Boyd
2010/0197423 A1 8/2010 Thomas et al.
2010/0197426 A1 8/2010 De La Cruz et al.
2010/0234127 A1 9/2010 Snyder et al.
2010/0261546 A1 10/2010 Nicodem
2010/0273569 A1 10/2010 Soracco
2010/0292024 A1 11/2010 Hagood et al.
2010/0304877 A1 12/2010 Iwahashi et al.
2011/0021284 A1* 1/2011 Stites ..... A63B 53/04 473/329
2011/0098127 A1 4/2011 Yamamoto
2011/0098128 A1 4/2011 Clausen et al.
2011/0118051 A1 5/2011 Thomas
2011/0152001 A1 6/2011 Hirano
2011/0195798 A1 8/2011 Sander et al.
2011/0218053 A1* 9/2011 Tang ..... A63B 53/04 473/349
2011/0256951 A1 10/2011 Soracco et al.
2011/0256954 A1 10/2011 Soracco
2011/0294599 A1* 12/2011 Albertsen ..... A63B 53/0466 473/349
2011/0312437 A1 12/2011 Sargent et al.
2012/0077615 A1 3/2012 Schmidt
2012/0083362 A1 4/2012 Albertsen et al.
2012/0083363 A1 4/2012 Albertsen et al.
2012/0122601 A1 5/2012 Beach et al.
2012/0135821 A1 5/2012 Boyd et al.
2012/0142447 A1* 6/2012 Boyd ..... A63B 53/0466 473/329
2012/0142452 A1* 6/2012 Burnett ..... A63B 53/0466 473/345
2012/0184393 A1 7/2012 Franklin
2012/0196701 A1* 8/2012 Stites ..... A63B 53/0466 473/345
2012/0196703 A1 8/2012 Sander
2012/0202615 A1 8/2012 Beach et al.
2012/0225731 A1 9/2012 Suwa et al.
2012/0302366 A1 11/2012 Murphy
2013/0017901 A1 1/2013 Sargent et al.
2013/0065705 A1 3/2013 Morales et al.
2013/0102410 A1 4/2013 Stites et al.
2014/0018184 A1 1/2014 Bezilla et al.
2014/0080629 A1 3/2014 Sargent et al.
2014/0256461 A1 9/2014 Beach et al.
2015/0038261 A1 2/2015 Stites et al.
2015/0231453 A1 8/2015 Harbert et al.
2015/0258395 A1 9/2015 Oldknow et al.
2016/0151685 A1 6/2016 Larson et al.
2016/0151686 A1 6/2016 Larson et al.
2016/0151687 A1 6/2016 Larson et al.

FOREIGN PATENT DOCUMENTS

CN 1984698 A 6/2007
EP 2377586 A2 10/2011
FR 2672226 A1 8/1992
FR 2717701 A1 9/1995
FR 2717702 A1 9/1995
GB 2280380 A 2/1995
GB 2388792 A 11/2003
JP S5163452 U 5/1976
JP 05237207 A * 9/1993 ..... A63B 53/0466
JP H05317465 A 12/1993
JP 06114127 A * 4/1994
JP H0639036 U 5/1994
JP 06190088 A * 7/1994
JP H06233837 A 8/1994
JP H07255886 A 10/1995
JP H07275407 A 10/1995
JP H07284546 A 10/1995
JP H08000785 1/1996
JP H08131599 A 5/1996
JP 08141117 A * 6/1996
JP 09000665 A * 1/1997
JP H0947528 A 2/1997
JP 09173510 A * 7/1997 ..... A63B 53/0466

(56) References Cited

FOREIGN PATENT DOCUMENTS

| | | | | | |
|---|---|---|---|---|---|
| JP | H09276455 | A | | 10/1997 | |
| JP | H10277180 | A | | 10/1998 | |
| JP | H10305119 | A | | 11/1998 | |
| JP | H1157082 | A | | 3/1999 | |
| JP | H11169493 | A | | 6/1999 | |
| JP | H11244431 | A | | 9/1999 | |
| JP | 2980002 | B2 | | 11/1999 | |
| JP | 11299938 | A | * | 11/1999 | |
| JP | 2000126340 | A | | 5/2000 | |
| JP | 11114102 | | | 6/2000 | |
| JP | 2000176056 | A | | 6/2000 | |
| JP | 2000197718 | A | * | 7/2000 | ..... A63B 53/04 |
| JP | 2000197718 | A | | 7/2000 | |
| JP | 2000271253 | A | | 10/2000 | |
| JP | 2001054596 | A | | 2/2001 | |
| JP | 2001058015 | A | * | 3/2001 | |
| JP | 2001062004 | A | * | 3/2001 | |
| JP | 2001137396 | A | * | 5/2001 | |
| JP | 2001145712 | A | * | 5/2001 | |
| JP | 3216041 | B2 | | 10/2001 | |
| JP | 2001293113 | A | | 10/2001 | |
| JP | 2001309999 | A | * | 11/2001 | ..... A63B 53/0466 |
| JP | 2002017908 | A | | 1/2002 | |
| JP | 2002017912 | A | | 1/2002 | |
| JP | 2002052099 | A | * | 2/2002 | |
| JP | 2002165905 | A | | 6/2002 | |
| JP | 2002177416 | A | | 6/2002 | |
| JP | 2002239040 | A | * | 8/2002 | |
| JP | 2002248183 | A | | 9/2002 | |
| JP | 2002306646 | A | * | 10/2002 | |
| JP | 2002306647 | A | | 10/2002 | |
| JP | 2003000774 | A | * | 1/2003 | ..... A63B 53/04 |
| JP | 2003079769 | A | * | 3/2003 | ..... A63B 53/0466 |
| JP | 2003093554 | A | * | 4/2003 | ..... A63B 53/0466 |
| JP | 2003210627 | A | * | 7/2003 | |
| JP | 2004174224 | A | * | 6/2004 | ..... A63B 53/0466 |
| JP | 2004216131 | A | | 8/2004 | |
| JP | 2004313762 | A | * | 11/2004 | |
| JP | 2004329544 | A | * | 11/2004 | |
| JP | 2004351054 | A | | 12/2004 | |
| JP | 2004351173 | A | * | 12/2004 | |
| JP | 2005013529 | A | | 1/2005 | |
| JP | 2005073736 | A | | 3/2005 | |
| JP | 2005137940 | A | | 6/2005 | |
| JP | 2005193069 | A | * | 7/2005 | |
| JP | 2005253973 | A | | 9/2005 | |
| JP | 2005305178 | A | | 11/2005 | |
| JP | 2006000435 | A | | 1/2006 | |
| JP | 2006020817 | A | | 1/2006 | |
| JP | 2006094965 | A | | 4/2006 | |
| JP | 2006198251 | A | | 8/2006 | |
| JP | 2006223701 | A | | 8/2006 | |
| JP | 2007136069 | A | * | 6/2007 | ..... A63B 53/0466 |
| JP | 2007209722 | A | | 8/2007 | |
| JP | 2007244480 | A | | 9/2007 | |
| JP | 2007275253 | A | * | 10/2007 | ..... A63B 53/0466 |
| JP | 2007530151 | A | | 11/2007 | |
| JP | 2008036315 | A | | 2/2008 | |
| JP | 2008515560 | A | | 5/2008 | |
| JP | 2008173293 | A | | 7/2008 | |
| JP | 2008200118 | A | * | 9/2008 | |
| JP | 2008237689 | A | | 10/2008 | |
| JP | 2008289866 | A | | 12/2008 | |
| JP | 2009160050 | A | * | 7/2009 | |
| JP | 2009201744 | A | | 9/2009 | |
| JP | 2009534546 | A | | 9/2009 | |
| JP | 2009279373 | A | * | 12/2009 | ..... A63B 53/0466 |
| JP | 2010005131 | A | * | 1/2010 | |
| JP | 2010029590 | A | * | 2/2010 | ..... A63B 53/0466 |
| JP | 2010035915 | A | * | 2/2010 | |
| JP | 2010148652 | A | | 7/2010 | |
| JP | 2010148653 | A | | 7/2010 | |
| JP | 2010154875 | A | * | 7/2010 | ..... A63B 53/10 |
| JP | 2010154887 | A | | 7/2010 | |
| JP | 2010279847 | A | * | 12/2010 | |
| JP | 2011024999 | A | | 2/2011 | |
| JP | 2011072661 | A | * | 4/2011 | |
| JP | 2011206535 | A | | 10/2011 | |
| JP | 2014087570 | A | * | 5/2014 | |
| WO | 9920358 | A1 | | 4/1999 | |
| WO | 0149376 | A1 | | 7/2001 | |
| WO | 200505842 | A1 | | 1/2005 | |
| WO | 2006073930 | A2 | | 7/2006 | |
| WO | 2007123970 | A2 | | 11/2007 | |
| WO | 2008157691 | A2 | | 12/2008 | |
| WO | 2009035345 | A1 | | 3/2009 | |
| WO | 2011153067 | A1 | | 12/2011 | |
| WO | 2012149385 | A1 | | 11/2012 | |

OTHER PUBLICATIONS

Dec. 18, 2012—(WO) International Search Report and Written Opinion App. No. PCT/US2012/057490.

May 30, 2012—(WO) International Search Report and Written Opinion App. No. PCT/US2012/022027.

Nov. 26, 2010—(WO) International Search Report and Written Opinion App. No. PCT/US2010/043073.

"Photographs 1, 2 and 3", presented in U.S. Appl. No. 12/842,650, of unknown source, taken after the filing date of the U.S. Appl. No. 12/842,650, depicting a golf club product; presented to the Patent Office for consideration on Oct. 7, 2011.

Nov. 5, 2010—(WO) International Search Report & Written Opinion, App. No. PCT/US2009/064164.

Mar. 20, 2014—(WO) International Search Report and Written Opinion App. No. PCT/US2013/043641.

Nov. 6, 2013—(WO) Partial Search Report, App.No. PCT/US2013/043641.

United States Golf Association; Procedure for Measuring the Flexibility of a Golf Clubhead, USGA-TPX3004; Revision 1.0.0; May 1, 2008; p. 1-11.

Apr. 12, 2010—(WO) Partial Search Report App. No. PCT/US2010/021355.

Sep. 9, 2011—(WO) International Search Report and Written Opinion, App. No. PCT/US2011/023678.

Jul. 7, 2010—(WO) International Search Report and Written Opinion, App. PCT/US2010/021355.

* cited by examiner

GOLF CLUB HEADS OR OTHER BALL STRIKING DEVICES HAVING DISTRIBUTED IMPACT RESPONSE

CROSS-REFERENCE TO RELATED APPLICATIONS

This application is a continuation of U.S. patent application Ser. No. 14/809,970, filed Jul. 27, 2015, which is a continuation of U.S. patent application Ser. No. 13/308,036, filed Nov. 30, 2011, and issued as U.S. Pat. No. 9,089,747, on Jul. 28, 2015, which application claims priority to and the benefit of U.S. Provisional Application No. 61/418,240, filed Nov. 30, 2010, and U.S. Provisional Application No. 61/541,767, filed Sep. 30, 2011, and the present application claims priority to all of such prior applications, which are all incorporated herein by reference in their entireties.

TECHNICAL FIELD

The invention relates generally to ball striking devices, such as golf clubs and heads. Certain aspects of this invention relate to golf clubs and golf club heads having a face that has an impact response that is distributed between the face and the body of the head.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. The distance and direction of ball flight can also be significantly affected by the spin imparted to the ball by the impact with the club head. Various golf club heads have been designed to improve a golfer's accuracy by assisting the golfer in squaring the club head face at impact with a golf ball.

The flexing behavior of the ball striking face and/or other portions of the head during impact can influence the energy and velocity transferred to the ball, the direction of ball flight after impact, and the spin imparted to the ball, among other factors. The flexing or deformation behavior of the ball itself during impact can also influence some or all of these factors. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing limit (e.g., currently 0.83) set by the United States Golf Association (USGA), which may change over time. However, because golf clubs are typically designed to contact the ball at or around the center of the face, off-center hits may result in less energy being transferred to the ball, decreasing the distance of the shot. In existing club head designs, the face is somewhat flexible and typically acts in a trampoline-like manner during impact with the ball, deforming inward upon impact and transferring energy to the ball as the face returns to its original shape. In this configuration, the face typically has the area of highest response (as described above) at or near the center of the face, which produces the greatest energy transfer and highest COR of the face. Typically, the "trampoline" action is maximized at the area of highest response, or in other words, the amplitude of the face deformation is typically highest there. Accordingly, club head features that can increase the energy transferred to a ball during impact, without exceeding the applicable COR limit, can be advantageous.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface and being defined by a plurality of face edges, and a body connected to the face and extending rearward from the face edges to define an enclosed volume, the body having a heel side, a toe side, a crown, and a sole. The face includes a face plate forming at least a portion of the ball striking surface and a cellular stiffening structure engaged with a rear surface of the face plate, the cellular stiffening structure providing increased stiffness to the face. The body has a crown channel portion extending at least partially across the crown and a sole channel portion extending at least partially across the sole. The crown channel portion is defined by boundary edges, with the crown channel portion being recessed from the crown between the boundary edges of the crown channel portion. The sole channel portion is also defined by boundary edges, with the sole channel portion being recessed from the sole between the boundary edges of the sole channel portion. The crown channel portion and the sole channel portion are spaced rearwardly from the face edges by spacing portions, and are configured such that at least some energy from an impact on the ball striking surface is transferred through the spacing portion(s) and absorbed by at least one of the crown channel portion and the sole channel portion, causing the at least one of the crown channel portion and the sole channel portion to deform and to exert a response force on the face.

According to one aspect, the head further includes a channel extending around the body and spaced rearwardly from the face edges by a spacing portion, the channel being defined by boundary edges and being recessed from an outer surface of the body between the boundary edges. The channel contains the crown channel portion, the sole channel portion, and additional channel portions interconnecting the crown and sole channel portions.

According to another aspect, the boundary edges of the crown channel portion define a complete boundary of the crown channel portion and the boundary edges of the sole channel portion define a complete boundary of the sole channel portion separate from the crown channel portion.

According to a further aspect, the body has lower stiffness at the crown channel portion and the sole channel portion as compared to a majority of other locations on the body. The body may have lower stiffness at the crown channel portion and the sole channel portion as compared to the spacing portion.

According to yet another aspect, a geometric center of the face has higher stiffness as compared to the crown channel portion and the sole channel portion.

According to a still further aspect, the face further includes a rear plate, where the cellular stiffening structure is sandwiched between the rear plate and the face plate.

According to an additional aspect, the cellular stiffening structure occupies an area smaller than an area of the ball striking surface, such that the cellular stiffening structure is retracted from the face edges.

According to another aspect, the at least one of the crown channel portion and the sole channel portion is configured such that a majority of the energy of the impact is absorbed by the at least one of the crown channel portion and the sole channel portion, and a majority of a response of the face during the impact is derived directly from the response force exerted by the at least one of the crown channel portion and the sole channel portion on the face.

Additional aspects of the invention relate to a ball striking device that includes a face having a ball striking surface, the face being defined by a plurality of face edges, and a body connected to the face and extending rearward from the face edges to define an enclosed volume, the body having a heel side, a toe side, a crown, and a sole. The face includes a face plate forming at least a portion of the ball striking surface and a porous stiffening structure engaged with a rear surface of the face plate, the porous stiffening structure providing increased stiffness to the face. The body includes a crown channel portion extending laterally at least partially across the crown, from a first end more proximate the heel side to a second end more proximate the toe side, and/or a sole channel portion extending laterally at least partially across the sole, from a first end more proximate the heel side to a second end more proximate the toe side. The crown and/or sole channel portion is defined by boundary edges, with the channel portion being recessed from the crown or sole between the boundary edges of the channel portion. The crown and/or sole channel portion is configured such that at least some energy from an impact on the ball striking surface is transferred from the face to the respective channel portion and is absorbed by the channel portion, causing the channel portion to deform and to exert a response force on the face.

According to one aspect, the body has lower stiffness at the channel portion as compared to portions of the body located immediately adjacent to the boundary edges of the channel portion.

According to another aspect, a geometric center of the face has higher stiffness as compared to the channel portion.

According to a further aspect, the face further includes a rear plate, such that the cellular stiffening structure is sandwiched between the rear plate and the face plate.

According to yet another aspect, the channel portion includes a first section extending laterally across the crown or sole and at least one second section extending rearwardly from an end of the first section.

According to a still further aspect, the device includes a crown channel portion that is substantially symmetrical and centered approximately on a geometric center line of the body. The body may further include a second crown channel portion located proximate the toe side of the body and defined by second boundary edges and a third crown channel portion located proximate the heel side of the body and defined by third boundary edges, with the second and third crown channel portions being recessed from the crown between the second and third boundary edges, respectively. The boundary edges of the crown channel portion and the second and third boundary edges of the second and third crown channel portions do not intersect, such that the crown channel portion is disconnected from the second and third crown channel portions.

According to an additional aspect, the device includes a crown channel portion that includes a first recess and a second recess that are recessed from the boundary edges, and a ridge separating the first and second recesses.

According to another aspect, the crown and/or sole channel portion is configured such that a majority of the energy of the impact is absorbed by the channel portion and a majority of a response of the face during the impact is derived directly from the response force exerted by the channel portion on the face.

Further aspects of the invention relate to a golf club head that includes a face having a ball striking surface, the face being defined by a plurality of face edges, and a body having an opening receiving the face therein. The body is connected to the face by welding the face to a periphery of the opening around the face edges, such that the body extends rearward from the face edges to define an enclosed volume, and the body has a heel side, a toe side, a crown, and a sole. The face includes a face plate forming at least a portion of the ball striking surface, a rear plate located behind the face plate, and a honeycomb stiffening structure sandwiched between the face plate and the rear plate, with the honeycomb stiffening structure providing increased stiffness to the face and having a greater thickness than the face plate and the rear plate. The body includes a channel defined by first and second boundary edges extending annularly around at least a majority of a circumference of the body and generally equidistant from the face edges. The channel is recessed from outer surfaces of the body between the first and second boundary edges and includes a crown channel portion extending at least partially across the crown, a sole channel portion extending at least partially across the sole, and at least one additional channel portion extending around at least one of the heel and the toe to interconnect the crown channel portion and the sole channel portion to form the channel in a continuous shape. The channel is spaced rearwardly from the face edges by a spacing portion, and the channel is configured such that at least some energy from an impact on the ball striking surface is transferred through the spacing portion and absorbed by the channel, causing the channel to deform and to exert a response force on the face.

According to one aspect, the channel is configured such that a majority of the energy of the impact is absorbed by the channel, and a majority of a response of the face during the impact is derived directly from the response force exerted by the channel on the face.

According to another aspect, the channel extends annularly around the circumference of the body, and includes additional channel portions extending around both the heel and the toe to interconnect the crown channel portion and the sole channel portion.

Other aspects of the invention relate to a golf club or other ball striking device including a head or other ball striking device as described above and a shaft connected to the head and configured for gripping by a user. Aspects of the invention relate to a set of golf clubs including at least one golf club as described above. Yet additional aspects of the invention relate to a method for manufacturing a ball striking device as described above, including forming a ball striking device as described above.

BRIEF DESCRIPTION OF THE DRAWINGS

To allow for a more full understanding of the present invention, it will now be described by way of example, with reference to the accompanying drawings in which.

Figure 1:
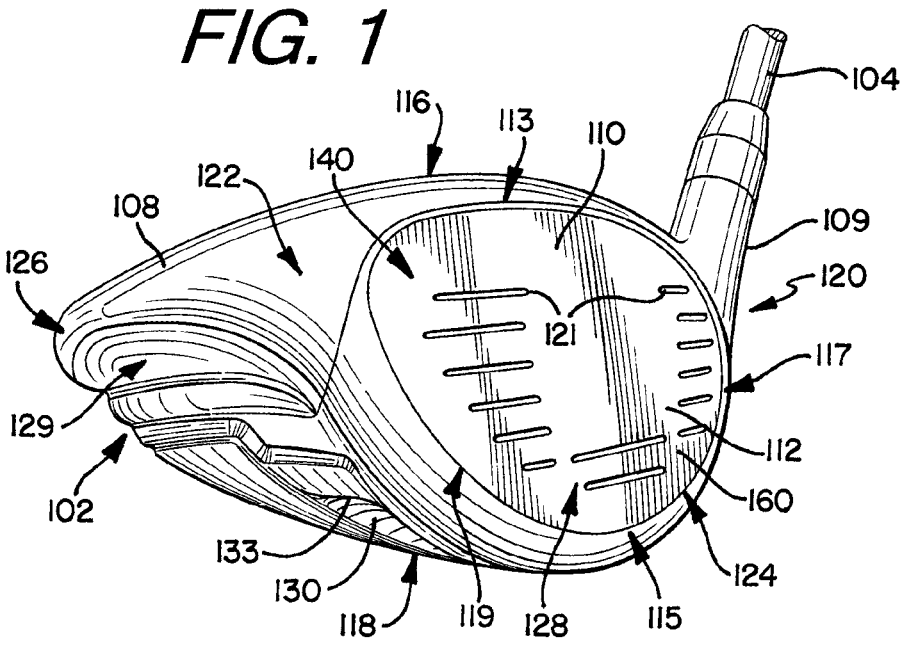
FIG. 1 is a perspective view of an illustrative embodiment of a head of a wood-type ball striking device according to aspects of the present invention.

It is understood that the relative sizes of the components in these Figures and the degrees of deformation of the components shown in the Figures may be exaggerated in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage to one or more of the pieces.

"Approximately" or "about" means within a range of +/−10% of the nominal value modified by such term.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, in accordance with at least some examples of this invention.

Figure 2:
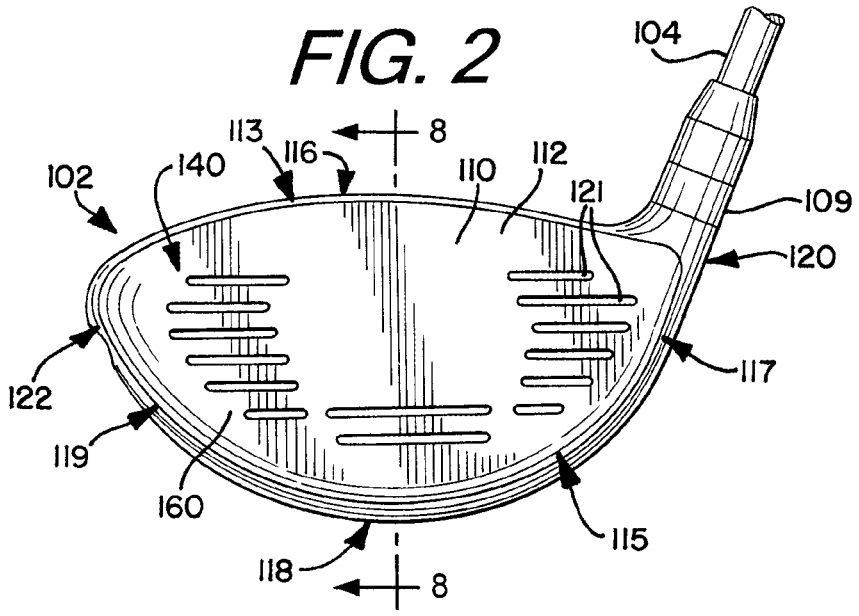
FIG. 2 is a front view of the head of FIG. 1.
Figure 3:
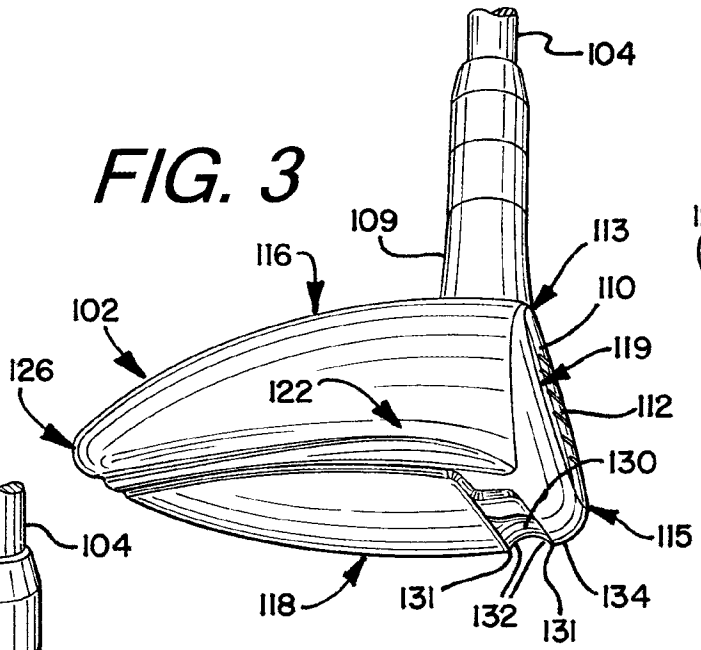
FIG. 3 is a left side view of the head of FIG. 1.
Figure 4:
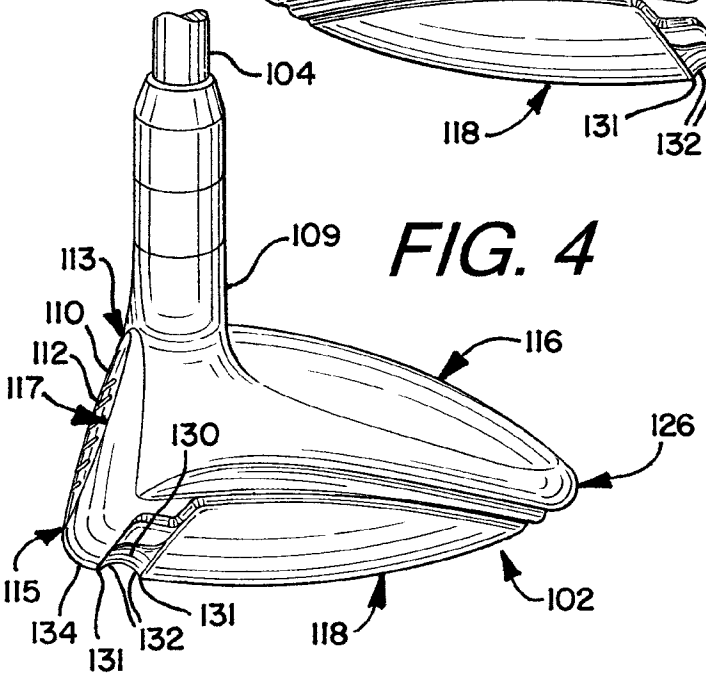
FIG. 4 is a right side view of the head of FIG. 1.

FIGS. 1-8A illustrate a ball striking device 100 in the form of a golf driver, in accordance with at least some examples of the invention, and FIGS. 9-30 illustrate various additional embodiments of a golf driver or other wood-type golf club in accordance with aspects of the invention. As shown in FIGS. 1-3, the ball striking device 100 includes a ball striking head 102 and a shaft 104 connected to the ball striking head 102 and extending therefrom. As shown in FIGS. 1-6, the ball striking head 102 of the ball striking device 100 of FIG. 1 has a face 112 connected to a body 108, with a hosel 109 extending therefrom. For reference, the head 102 generally has a top or crown 116, a bottom or sole 118, a heel or heel side 120 proximate the hosel 109, a toe or toe side 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 (shown in FIG. 8A) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the embodiment illustrated in FIGS. 1-8, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 107 may not be completely enclosed in some embodiments. In the embodiment as illustrated in FIGS. 1-6, the body 108 of the head 102 has a rounded rear profile. In other embodiments, the body 108 of the head 102 can have another shape or profile, including a squared or rectangular rear profile, or any of a variety of other shapes. It is understood that such shapes may be configured to distribute weight away from the face 112 and/or the geometric/volumetric center of the head 102, in order to create a lower center of gravity and/or a higher moment of inertia. The body 108 may be connected to the hosel 109 for connection to a shaft 104, as described below.

The face 112 is located at the front 124 of the head 102, and has a ball striking surface 110 located thereon and an inner surface 111 (FIGS. 7-8A) opposite the ball striking surface 110. The ball striking surface 110 is typically an outer surface of the face 112 configured to face a ball 106 in use, and is adapted to strike the ball 106 when the device 100 is set in motion, such as by swinging. The face 112 is defined by peripheral edges or face edges, including a top edge 113, a bottom edge 115, a heel edge 117, and a toe edge 119. Additionally, in this embodiment, the face 112 has a plurality of face grooves 121 on the ball striking surface 110, which do not extend across the center of the face 112. In another embodiment, such as a fairway wood head or a hybrid wood-type head, the face 112 may have grooves 121 that extend across at least a portion of the center of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

Figure 7:
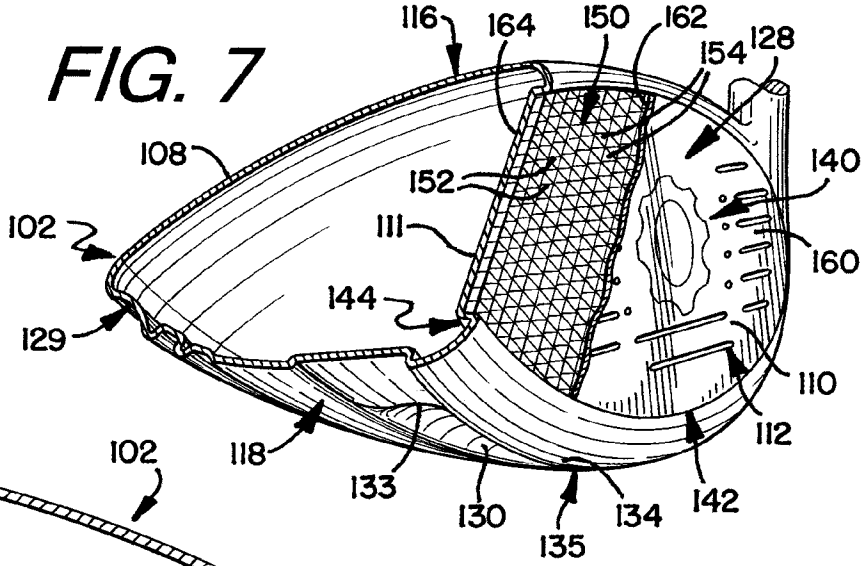
FIG. 7 is a partially-exploded perspective cross-sectional view of the head of FIG. 1.
Figure 8:
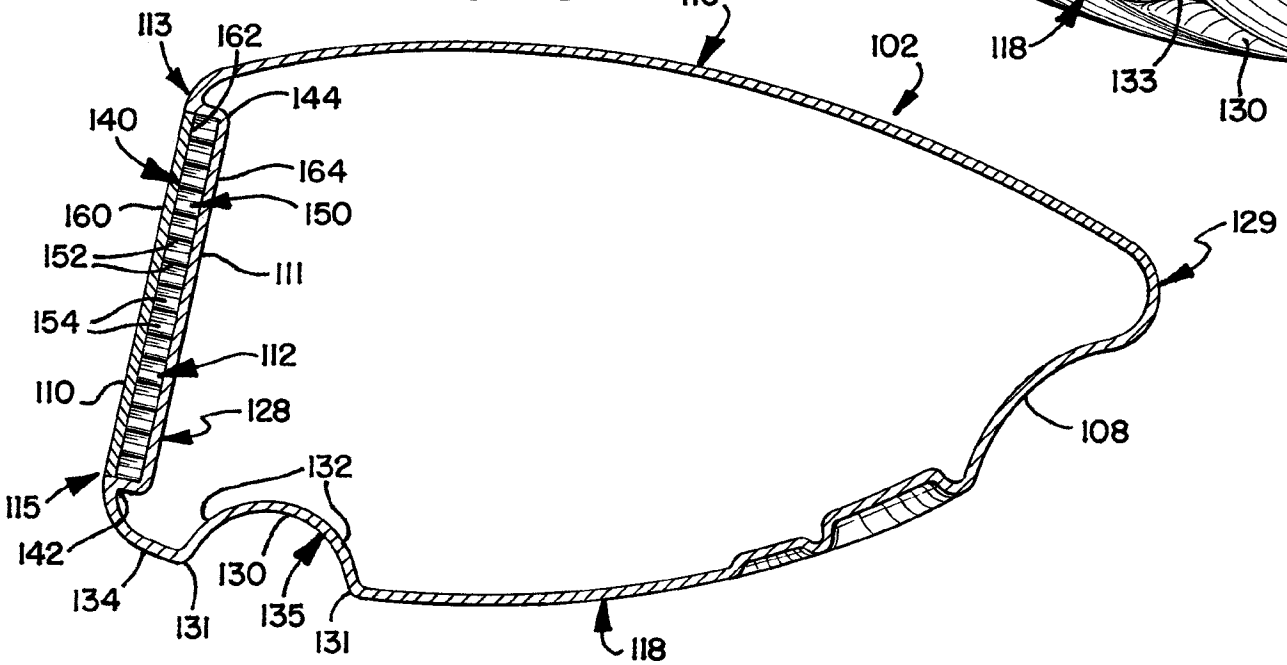
FIG. 8 is a cross-sectional view of the head of FIG. 1, taken along lines 8-8 of FIG. 2.

It is understood that the face 112, the body 108, and/or the hosel 109 can be formed as a single piece or as separate pieces that are joined together. In one embodiment, the face 112 may be wholly or partially formed by a face member 128 with the body 108 being partially or wholly formed by a body member 129 including one or more separate pieces connected to the face member 128, as in the embodiment shown in FIGS. 7-8A, for example. In this embodiment, the body member 129 has an opening 140 defined by a peripheral opening edge 142, which is dimensioned to receive the face member 128 therein. As shown in FIGS. 7-8, the face member 128 is defined by peripheral edges 144 that are connected to the body member 129 around the peripheral edge 142 of the opening 140, such as by welding all or a portion of the juncture between the peripheral edges 142, 144. These pieces may be connected by another integral joining technique instead of, or in addition to welding, such as cementing or adhesively joining. The structure and connection of the face member 128 and the body member 129 are described in further detail below. In other embodiments, the face member 128 and the body member 129 may be connected in another manner, such as using other known techniques for joining. For example, one or more of a variety of mechanical joining techniques may be used, including fasteners and other releasable mechanical engagement techniques. If desired, the hosel 109 may be integrally formed as part of the body member or the face member. In further embodiments, the face member 128 and/or the body member 129 may have a different configuration. For example, the face member 128 may be in the form of a "cup face" member or other such member having a wall or walls extending rearwardly from the face 112 for connection to the body member 129. Further, a gasket (not shown) may be included between the face member 128 and the body member 129 in some embodiments.

Figure 2A:
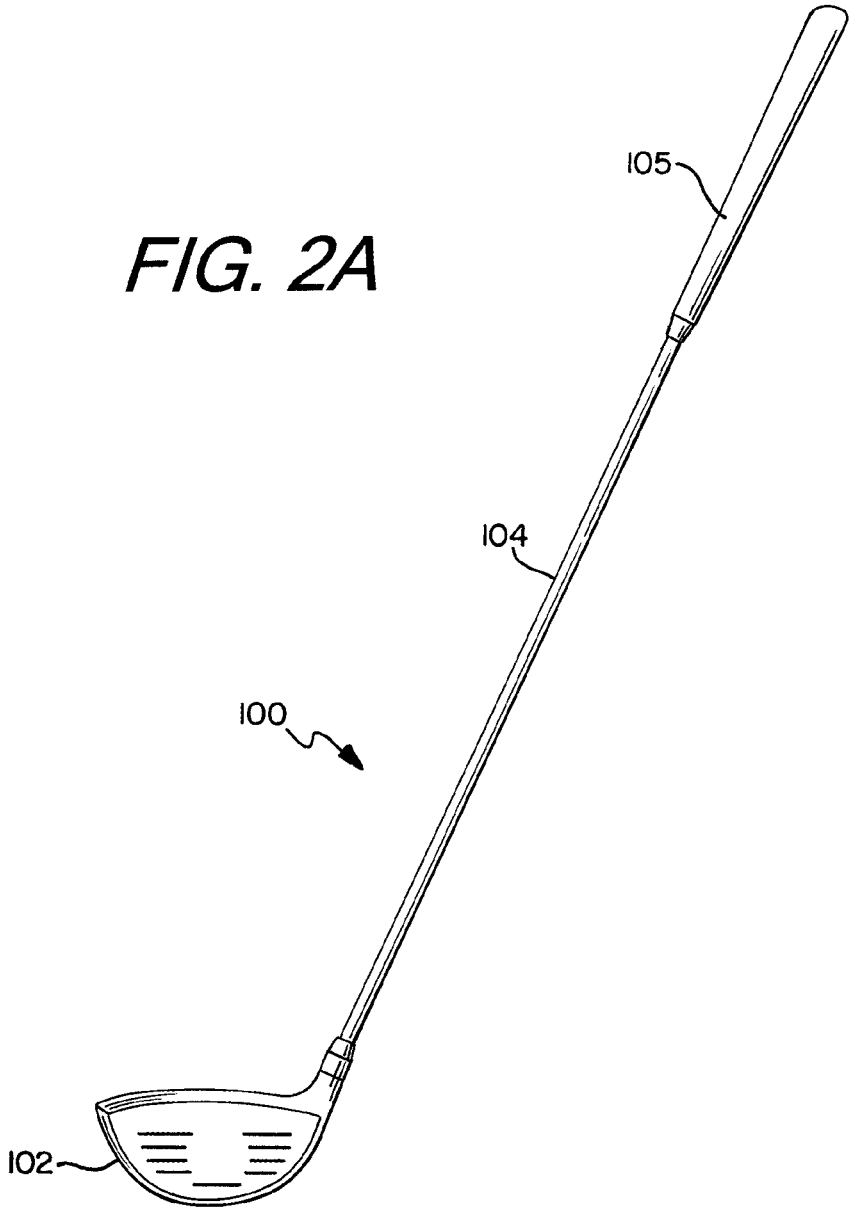
FIG. 2A is a perspective view of a golf club including the head of FIG. 1.
Figure 5:
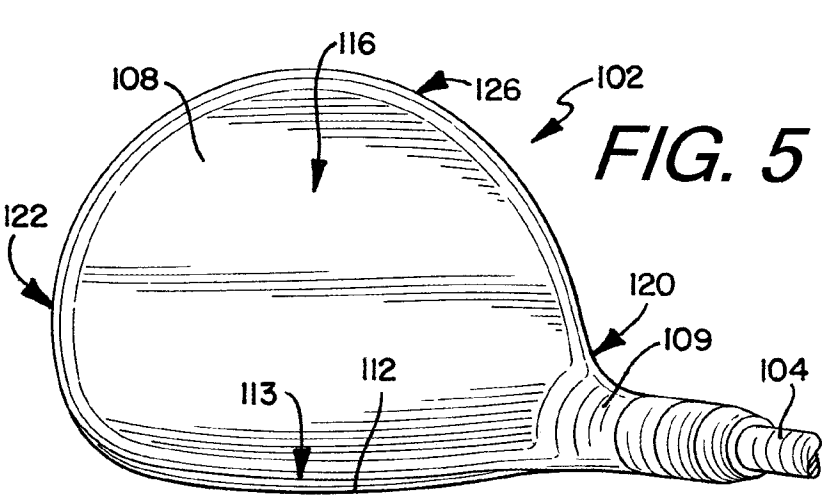
FIG. 5 is a top view of the head of FIG. 1.
Figure 6:
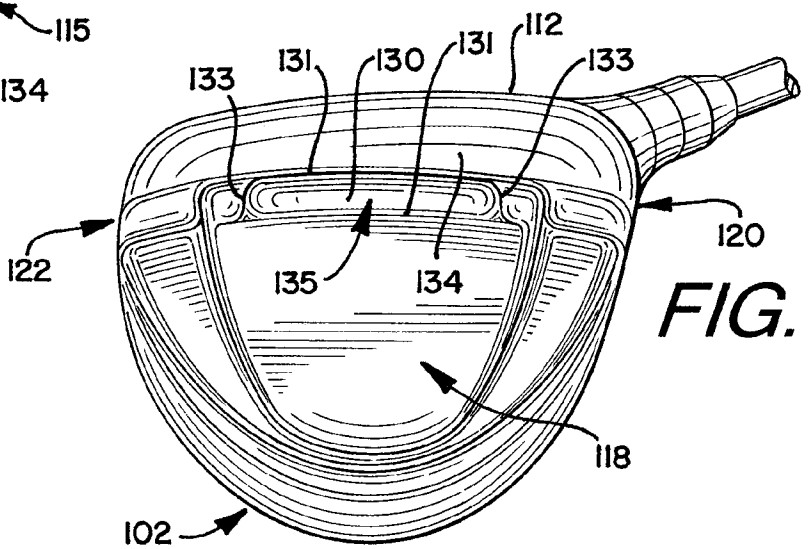
FIG. 6 is a bottom view of the head of FIG. 1.

The ball striking device 100 may include a shaft 104 connected to or otherwise engaged with the ball striking head 102, as shown in FIG. 2A. The shaft 104 is adapted to be gripped by a user to swing the ball striking device 100 to strike the ball 106. The shaft 104 can be formed as a separate piece connected to the head 102, such as by connecting to the hosel 109, as shown in FIG. 2A. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 2A. The grip element 105 may be attached to the shaft 104 in any desired manner, including in conventional manners known and used in the art (e.g., via adhesives or cements, threads or other mechanical connectors, swedging/swaging, etc.).

In general, the head 102 has a face 112 with increased stiffness relative to existing faces and/or a body 108 that has impact-influencing structural features that can affect the physics of the impact of the ball 106 with the face 112, such as the COR measured according to USGA testing procedures. The impact influencing features may take the form of one or more flexible portions that extends around at least a portion of the periphery of the body 108, adjacent to the peripheral edges 113, 115, 117, 119 of the face 112. The flexible portion(s) may be formed in many ways, including by channels or other structural features and/or by the use of flexible materials. In one embodiment, a majority of the force generated by impact with a ball 106 is absorbed by the impact-influencing features, and a majority of a response force generated by the head 102 upon impact with the ball 106 is generated by the impact-influencing structure. In existing golf club heads, the face 112 absorbs a significant majority of the impact force and generates a significant majority of the response force.

In the embodiment shown in FIGS. 1-8, the head 102 has a channel 130 (or channels) extending around at least a portion of the body 108 adjacent and generally parallel to the edges 113, 115, 117, 119 of the face 112. The embodiment illustrated in FIGS. 1-8 has a single channel 130 that allows at least a portion of the body 108 to flex, produce a reactive force, and/or change the behavior or motion of the face 112, during impact of a ball on the face 112. In this embodiment, the channel 130 permits compression and flexing of the body 108 during an impact on the face 112, and also produces a reactive force that can be transferred to the ball 106, as well as changing the motion and behavior of the face 112 during impact. As shown in FIGS. 3-4 and 6-7, in this embodiment, the channel 130 extends laterally at least partially across the sole 118 of the head 102 to form a sole channel portion 135, and the channel 130 extends from an end 133 proximate the heel 120 to an end 133 proximate the toe 122. The channel 130 in this embodiment is substantially symmetrically positioned on the head 102, and is spaced from the edges 113, 115, 117, 119 of the face 112 by a spacing portion 134. In another embodiment, the head 102 may have multiple channels 130 extending around all or part of the periphery of the head 102, such as in the embodiments described below.

The channel 130 illustrated in FIGS. 1-8 is recessed between the boundary edges 131 defining the channel 130, and is recessed inwardly with respect to surfaces of the head 102 that are in contact with the boundary edges 131, as shown in FIGS. 3-4 and 7-8. The channel 130 in this embodiment has a trough-like shape, with sloping sides 132 that are smoothly curved, as seen in FIGS. 3-4 and 7-8. Additionally, the channel 130 has a tapering depth in this embodiment, such that the channel 130 is shallower (measured by the degree of recess of the channel 130) at the ends 133 than at the center. The geometry of the channel 130 can affect the flexibility of the channel 130 and the corresponding response transferred through the face 112 to the ball 106. For example, the varying depth of the channel 130 may produce greater flexibility at different points in the channel 130. In other embodiments, different heads 102 can be produced having faces 112 with different responses, by using channels 130 with different geometries. As an example, the depth of the channel 130 may be varied in order to achieve specific flexibilities at specific locations on the channel 130. Other parameters may be likewise adjusted.

In other embodiments, the head may contain one or more channels 130 that are different in number, size, shape, depth, location, etc. For example, the channel 230 of the head 202 in FIGS. 9-14 extends 360° around the entire head 202, and the head 602 in FIGS. 25-30 has two channels 630 that together extend almost entirely around the head 602, as described below. In other examples, the heads 302, 402, 502 in FIGS. 19-24 have differently-shaped and configured channels 330, 430, 530 on their respective crowns 316, 416, 516. In additional examples, the channel(s) 130 may have a sharper and/or more polygonal cross-sectional shape, a different depth, and/or a different or tapering width in some embodiments. As a further example, the channel(s) 130 may be located only on the bottom 118, the heel 120, and/or the toe 122 of the head 102. As yet another example, the wall thickness of the body 108 may be increased or decreased at the channels 130, as compared to the thickness at other locations of the body 108, to control the flexibility of the channels 130. As a still further example, the channels 130 may be located on an inner surface of the body 108, rather than the outer surfaces. Still other configurations may be used and may be recognizable to those skilled in the art in light of the present specification. The channel 130 may also include an insert or other such filling structure that fills at least a portion of the channel 130. For example, an insert such as described in U.S. patent application Ser. No. 13/015,264, which is incorporated by reference herein in its entirety and made part hereof, may be utilized in the channel 130 in order to reduce drag or friction with the playing surface, or for other purposes.

As mentioned above, the face 112 has increased stiffness relative to existing faces for golf club heads. The increased stiffness of the face 112 can be achieved through various different means and structures, including through the use of high-strength and high-modulus materials and/or through the use of stiffening structures in the face 112. As used herein, stiffness is calculated using the equation:

$$S=E\times I$$

where "S" refers to stiffness, "E" refers to Young's modulus of the material, and "I" refers to the cross-sectional moment of inertia of the face 112. Accordingly, stiffness depends not only on the modulus (flexibility) of the material, but also on the thickness and shape of the face 112. For example, the face 112 can be made from a material having higher modulus and/or may also be made thicker than a normal face 112. In one embodiment, the face 112 may have a stiffness that is about 10 times greater than the stiffness of a typical titanium driver face (e.g. with a height of about 2.3 inches (57-58 mm) and a thickness of about 3 mm, and a modulus of 105 GPa), such as about 4,600-5,600 lb-in$^2$, or about 5,100 lb-in$^2$ (about 13.3-16.2 N-m$^2$, or about 14.7 N-m$^2$) in one example. These stiffness figures are measured at the geometric center and/or the hot zone of the face, which may be the cross-section plane of the face with the greatest height. Additionally, these stiffness figures are measured on the vertical axis, i.e. for bending across the thickness of the face 112 based on a force applied to the striking surface 110. Examples of materials having high modulus that may be used in the face include a variety of high-strength steel and titanium alloys, composites (including titanium-based composites, carbon fiber and other fiber-reinforced composites, and various other composites containing metals, polymers, ceramics, etc.), beryllium and beryllium alloys, molybdenum and molybdenum alloys, tungsten and tungsten alloys, other metallic materials (including alloys), high-strength polymers, ceramics, and other suitable materials. In one embodiment, the face 112 may utilize a material that has a modulus of at least 280 GPa. In another example, the face 112 may have stiffening structure that increases the stiffness of the face 112, such as through adding increased modulus and/or increasing the cross-sectional moment of inertia (I) of the face 112. Some examples of such stiffening means and structures are shown in FIGS. 13-21 and described below, including inserts and reinforcing structures. As a further example, any of the stiffening structures disclosed in U.S. Published Patent Application No. 2010/0130303, filed on Nov. 21, 2008, in the name of John T. Stites et al., or variations thereof, may be utilized to give increased stiffness to the face or localized areas thereof, which application is incorporated by reference herein and made part hereof. It is understood that a face 112 may include any combination of these stiffening techniques in some embodiments.

The face 112, or at least a portion of the face 112 including the CG and/or the geometric center of the face 112, may have a stiffness that is greater than the stiffness of at least a portion of the body 108. In one embodiment, a majority of the face 112 including the geometric center of the face 112 may include such increased stiffness. For example, in one embodiment, the face 112 may have a stiffness that is greater than the stiffness of any portion of the body 108. In another embodiment, the face 112 may have a stiffness that is at least greater than the stiffness of the channel 130. The channel 130 may also have a lower stiffness than at least some other portions of the body 108, which may be accomplished through the use of structure and/or materials (e.g. as in FIG. 29A). In one embodiment, the channel 130 has a lower stiffness than at least the spacing portion 134 or another portion of the body 108 adjacent to the channel 130. Other embodiments described herein may utilize faces and body features having similar stiffness or relative stiffness, including other embodiments of channels 230, et seq.

In one embodiment, the face 112 may include a stiffening structure that may have a cellular or other porous configuration. For example, in the embodiment illustrated in FIGS. 7-8, the face 112 includes a honeycomb cellular stiffening structure 150, formed by a plurality of structural members 152 defining symmetrical cells or chambers 154 between them in a honeycomb configuration. It is understood that "honeycomb" as used herein refers to a structure that contains cells 154 of substantially equal sizes, in a substantially symmetrical arrangement, which pass completely through the structure, and does not imply a hexagonal cellular shape. Indeed, the cells 154 in FIGS. 7-8 are quadrilateral in shape. In other embodiments, the face 112 may include a different type of honeycomb, cellular, and/or porous stiffening structure. As described below, the stiffening structure may be located behind and/or connected to a face plate 160 that forms at least a portion of the ball striking surface 110.

The face 112 illustrated in FIGS. 7-8 includes a face plate 160 that forms the ball striking surface 110, with the stiffening structure 150 being connected to a rear surface 162 of the face plate 160, such as by welding. The face 112 may also include a rear plate 164 that engages or is connected to the opposite side of the stiffening structure 150, forming a sandwich structure with the stiffening structure 150 sandwiched between the face plate 160 and the rear plate 164. In the embodiment illustrated, the face plate 160, the stiffening structure 150, and the rear plate 164 are integrally joined to form a single-piece face member 128 before connection to the body member 129. Further, in the embodiment of FIGS. 7-8, the face plate 160, the stiffening structure 150, and the rear plate 164 have similar peripheral dimensions and are substantially the same geometric size. In another embodiment, the rear plate 164 may be absent from the face 112, or may have a different size or proportion as compared to the stiffening structure 150 and/or the face plate 160, such as in the embodiments of FIGS. 15-18. The face plate 160, the stiffening structure 150, and/or the rear plate 164 may be made from any of the materials identified above. In one embodiment, face plate 160, the stiffening structure 150, and/or the rear plate 164 (if present) may be formed of titanium or titanium alloy or other metallic materials (including alloys), and may be connected to each other by welding, brazing, use of a bonding material, or other technique. The face member 128 may be connected to the body member 129 in this embodiment by welding, brazing, or similar technique, but may be connected using other techniques in other embodiments. In another embodiment, the face plate 160 and the rear plate 164 (if present) may be formed of a metallic material, and the stiffening structure 150 may be formed of a high strength polymer material or polymer/fiber composite. In this embodiment, the stiffening structure 150 may be connected to the metallic components via adhesive or another bonding material, and the face member 128 may be connected to the body member 129 using adhesive or another bonding material rather than welding, to ensure that welding temperatures do not affect the integrity of the polymer or the bonding material. As described elsewhere herein, the face member 128 having the polymeric stiffening structure 150 (or other polymeric component) may be in various forms, including a plate or a cup face structure (e.g. FIG. 33).

The stiffening structure 150 in this embodiment can increase stiffness of the face 112 through increasing the cross-sectional moment of inertia (I) of the face 112, with the structural members 152 of the stiffening structure 150 acting as braces for the face 112. In other embodiments, the face plate 160, the rear plate 164, and/or the stiffening structure 150 can be made from different materials. The face plate 160, the rear plate 164, and the stiffening structure 150 may have varying thicknesses and dimensions in different embodiments. For example, in one embodiment, the face 112 has a total thickness of 0.25 in., with the face plate 160 having a thickness of up to about 1/32 in (or about 0.03 in). In another embodiment, the face 112 may have a total thickness of up to about 0.25 in. Additionally, in one embodiment, the thicknesses of the structural members 152 of the stiffening structure 150 are about 0.002-0.006 in. The rear plate 164, if present, may have a thickness comparable to that of the face plate 160 in each of these embodiments. As a further example, the cells 154 may each have a width of from about 0.008 in. to 0.25 in. in one embodiment, or may have different widths in other embodiments. In one example embodiment, the cells may each have a width of 0.108 in., with a cell wall thickness of 0.004 in. In other embodiments, the structures may have different sizes and/or configurations. The face 112 as described above may have a stiffness that is greater than the stiffness at other locations on the head 102, including various locations on the body 108. For example, in one embodiment, the face 112 (including the geometric center of the face 112) may have a greater stiffness than the channel(s) 130, or may have a greater stiffness than any location on the body 108.

Figure 8A:
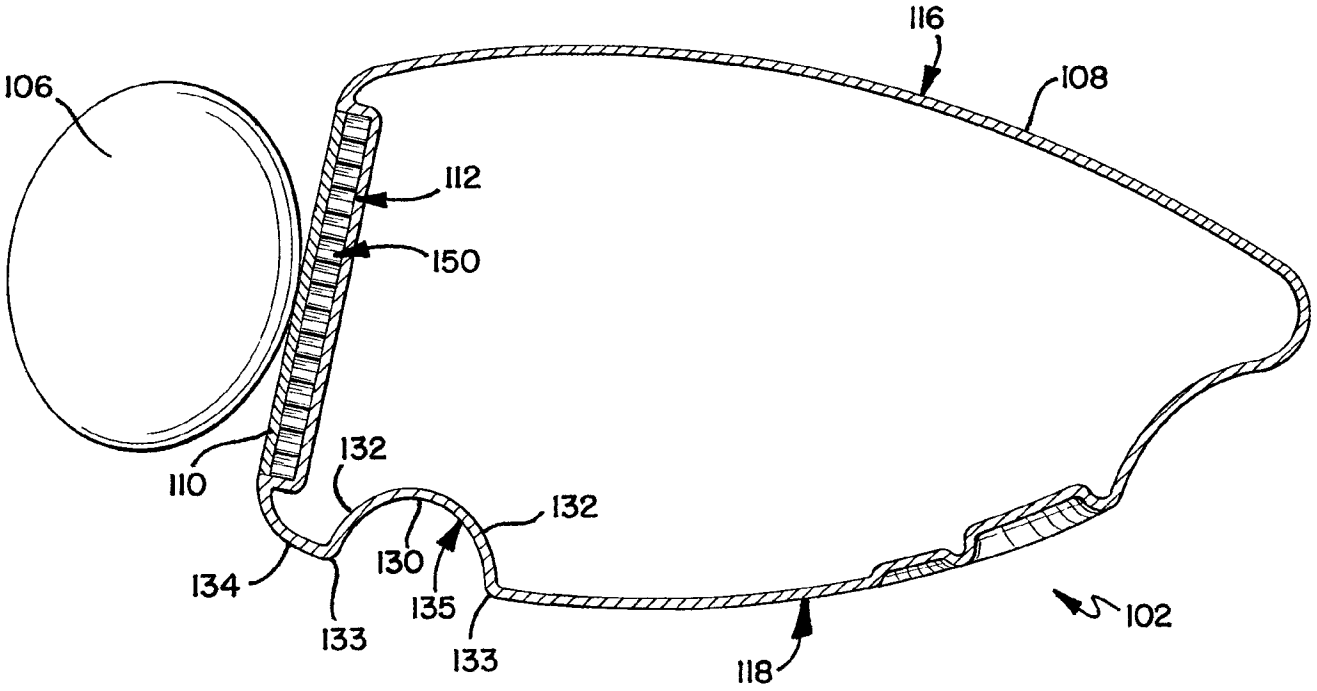
FIG. 8A is a cross-sectional view of the head as illustrated in FIG. 8, shown during an impact with a ball.
Figure 9:
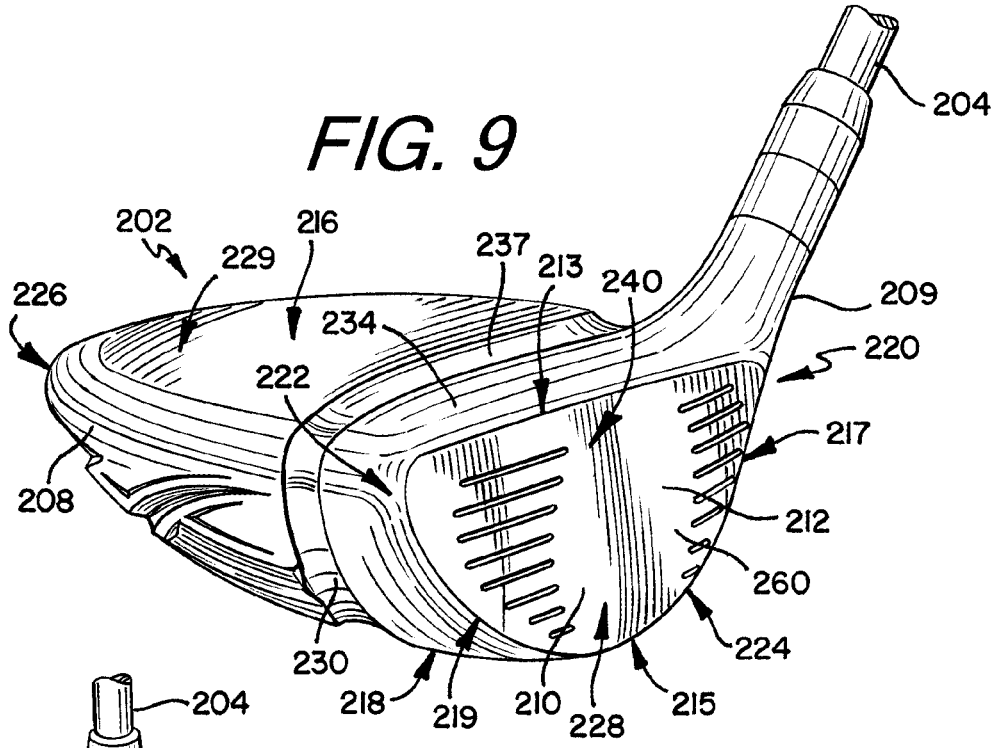
FIG. 9 is a perspective view of another illustrative embodiment of a head of a wood-type ball striking device according to aspects of the present invention.
Figure 10:
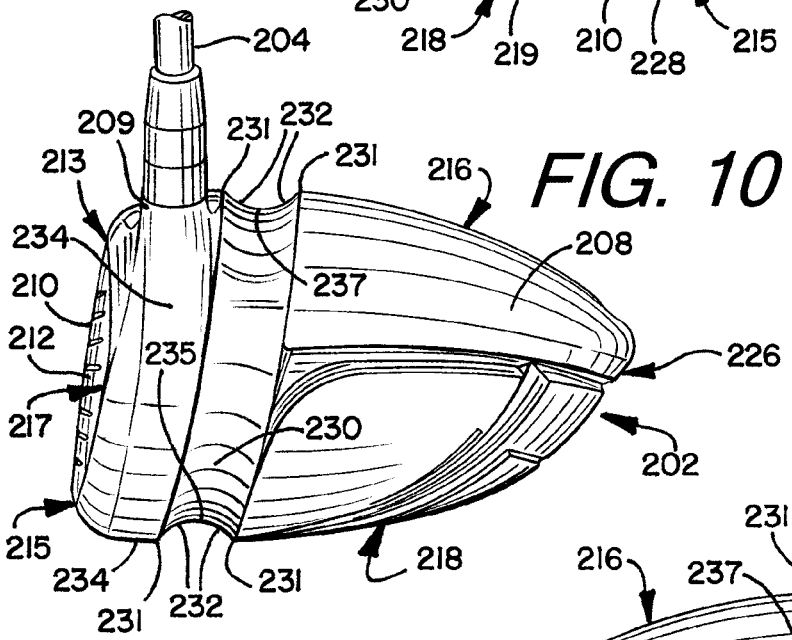
FIG. 10 is a right side view of the head of FIG. 9.
Figure 11:
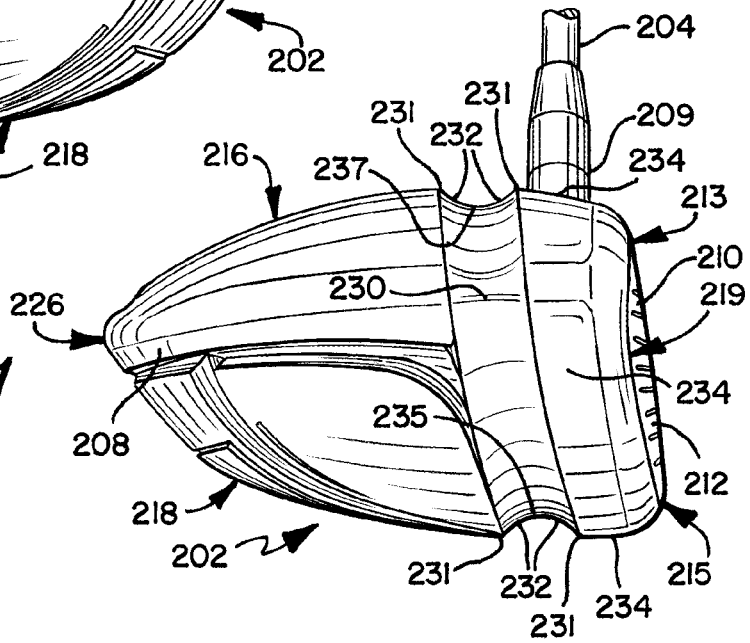
FIG. 11 is a left side view of the head of FIG. 9.
Figure 12:
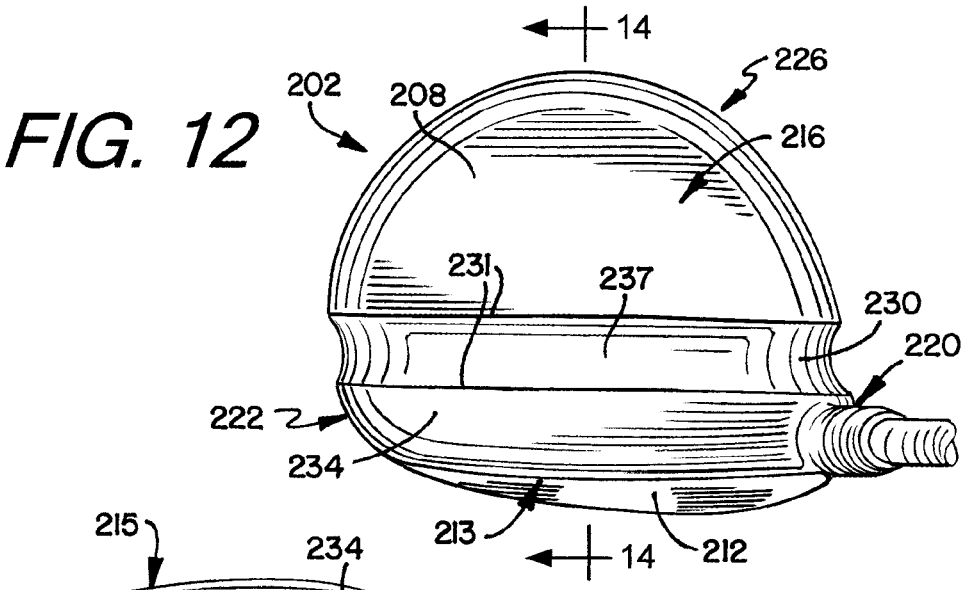
FIG. 12 is a top view of the head of FIG. 9.
Figure 13:
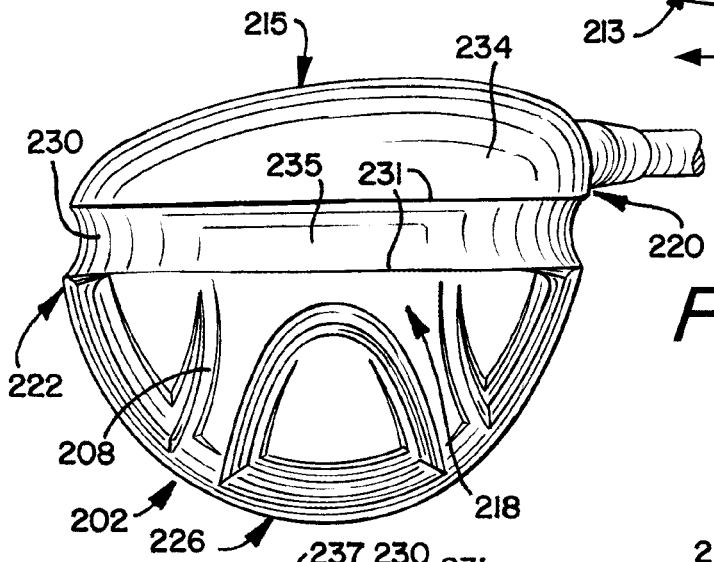
FIG. 13 is a bottom view of the head of FIG. 9.

A face 112 of the type illustrated in FIGS. 7-8A may have superior stiffness as compared to existing faces, but may have much less mass due to the porous structure, which permits weight savings in the face 112 to be added to a different part of the head 102 as desired. For example, a head 102 using the face 112 of FIGS. 7-8A may have a face 112 that has a thickness of 5-7 mm and a mass of 25 g in one embodiment, and 35 g in another embodiment. When impacted by the ball, all 25 g of the face will be involved in the impact, since the impact does not involve localized deformation or response on the face 112. In another embodiment, the face 812 may have a mass that is up to about 35 g, such as a face 112 with a mass of 20-35 g. In a further embodiment, the face 112 may have a mass that is between 25-30 g. In the embodiments described above, the remainder of the head 102 may have a weight of between 185-210 g, with the weight of the remainder of the head 102 in one embodiment being 200 g. This weight includes the hosel 109 and any adjustability structures associated with the hosel 109. The total weight of the portions of the head 102 behind the channel(s) 130 may be approximately 135-160 g, with approximately 27% of the weight of the head 102 being located from the channel(s) 130 forward and approximately 73% of the weight being located behind the channel(s) 130. In contrast, a typical face (e.g. the face 12 in FIG. 31) may have a thickness of about 3 mm and may have a mass of 45-50 g. When impacted by a ball 106, the mass of the face material that is involved in the impact (i.e. deforms and/or is located around the impact area) is around 5 g. Accordingly, the face 112 is lighter than existing faces, which permits the additional (e.g. 25 g) mass to be positioned on the body 108 while retaining the same total weight. Strategic positioning of this additional weight can be used to control the position of the center of gravity and/or the MOI of the head 102. The mass of the face 112 can be further lowered by using lighter materials. Likewise, the other embodiments of faces 212, et seq., described herein can have reduced mass through the use of lighter materials and/or porous or other lightweight structures.

Figure 31:
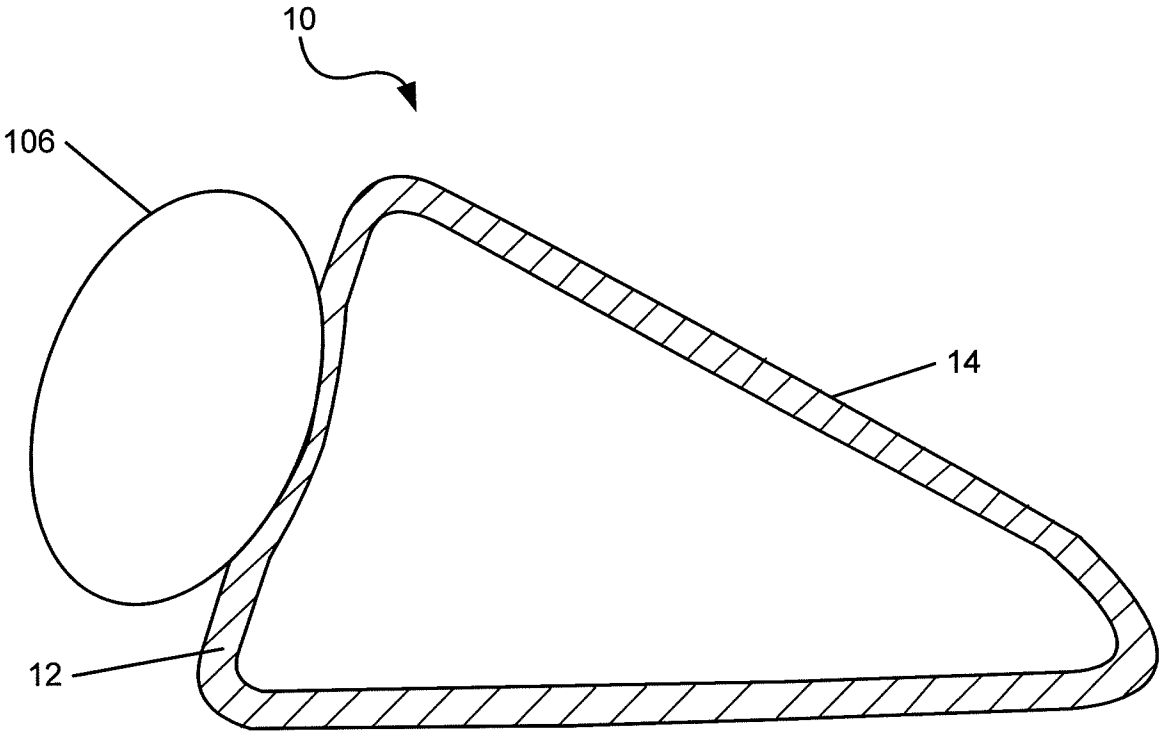
FIG. 31 PRIOR ART
FIG. 31 is a cross-sectional view of an example of a head of a prior art wood-type ball striking device, shown during an impact with a ball.

FIG. 8A illustrates an impact of a ball 106 on the face 112 of the head 102 as shown in FIGS. 1-8. As shown in FIG. 8A, when the ball 106 impacts the ball striking surface 110, the stiffened face 112 has very little to no deformation, and the force of the impact is transferred to the channel 130 on the body 108 of the head 102. The channel 130 deforms due to the impact force, as shown in FIG. 8A, and returns to its original configuration, as shown in FIG. 8, producing a response force that is transferred through the face 112 to the ball 106, propelling the ball 106 forward. The impact force and the response force are transmitted between the face 112 and the channel 130 through the spacing portion 134 positioned between the face 112 and the channel 130. In contrast, FIG. 31 illustrates an existing driver head 10, having a face 12 and a body 14 connected to the face 12, during an impact with the ball 106. As illustrated in FIG. 31, most or all of the deformation of the head 10 on impact occurs in the face 12, and the face 12 creates most or all of the response force on the ball 106, in contrast to the head 102 described above. The configuration shown in FIGS. 1-8A can achieve increased energy and velocity transfer to the ball 106 and increased response (COR) for impacts that are away from the center or traditional "sweet spot" of the face 112, such as high or low impacts or heel or toe impacts. The face 112 does not depend solely on localized "trampoline" effect for response force, and the response-producing channel 130 extends toward the heel 120 and toe 122, and overlap the heel and toe edges 117, 119 of the face 112.

The body 108 may have lower stiffness at the channel(s) 130 than at other locations on the body 108. For example, in one embodiment, the channel(s) 130 may have lower stiffness than a majority of other locations on the body 108, or the channel(s) 130 may have the lowest stiffness at any point on the body 108. Additionally, in one embodiment, a majority of the energy of the impact is absorbed by the channel(s) 130, and/or a majority of the response of the face 112 during the impact is derived directly from the response force exerted by the channel(s) 130 on the face 112. In embodiments where the head 102 has more than one channel 130 or multiple channel portions (e.g. the sole channel portion 135), a majority of the energy of the impact may be absorbed by one or more of such channels 130 or channel portions, and/or a majority of the response of the face 112 during the impact is derived directly from the response force exerted by one or more of such channels 130 or channel portions on the face 112. Further, in some embodiments, the channel(s) 130 may experience greater deformation than other portions of the head 102 during an impact with a ball 106, and may experience greater deformation than the face 112 during impact, e.g. at a typical professional golfer's swing speed of 155-160 ft/s. In one embodiment, one or more channels 130 on the head 102 may experience approximately 5-10 times greater deformation than the face 112 during an impact with a ball 106. Degree of deformation, in this context, may be measured by total distance of displacement and/or distance of displacement as a ratio or percentage of the thickness of the component. It is understood that other embodiments described herein may have the same or similar properties described above.

In some embodiments, the flexing of the channel 130 can create a more gradual impact with the ball 106 as compared to the traditional head 10 (FIG. 31), which results in a smaller degree of deformation of the ball 106 as compared to the traditional head 10. This smaller degree of deformation can result in greater impact efficiency and greater energy and velocity transfer to the ball 106 during impact. The more gradual impact created by the flexing can also create a longer impact time, which can result in greater energy and velocity transfer to the ball 106 during impact.

FIGS. 9-14A illustrate another embodiment of a head 202 having impact-influencing features on the body 208. Many features of this embodiment are similar or comparable to features of the head 102 described above and shown in FIGS. 1-8A, and such features are referred to using similar reference numerals under the "2xx" series of reference numerals, rather than "1xx" as used in the embodiment of FIGS. 1-8A. Accordingly, certain features of the head 202 that were already described above with respect to the head 102 of FIGS. 1-8A may be described in lesser detail, or may not be described at all.

In the embodiment shown in FIGS. 9-14A, the head 202 has a channel 230 (or channels) extending 360° around the entire periphery of the body 208 adjacent and generally parallel to the edges 213, 215, 217, 219 of the face 212. In this embodiment, the channel 230 allows at least a portion of the body 208 to flex, produce a reactive force, and/or change the behavior or motion of the face 212, during impact of a ball on the face 112. In this embodiment, the channel 230 permits compression and flexing of the body 208 during an impact on the face 212, and also produces a reactive force that can be transferred to the ball 106, as well as changing the motion and behavior of the face 212 during impact. As shown in FIGS. 9-14A, in this embodiment, the channel 230 extends laterally at least partially across the sole 218 to form a sole channel portion 235 and laterally at least partially across the crown 216 to form a crown channel portion 237. Additional portions of the channel 230 extend across at least a portion of the heel 220 and the toe 222 of the head 202 to interconnect the crown channel portion 237 and the sole channel portion 235, and the channel 230 is spaced from the peripheral edges 213, 215, 217, 219 of the face 212 by a spacing portion or portions 234.

The channel 230 illustrated in FIGS. 9-14A is recessed between the boundary edges 231 defining the channel 230, and is recessed inwardly with respect to surfaces of the head 202 that are in contact with the boundary edges 231, as similarly described above. The channel 230 in this embodiment has a trough-like shape, with sloping sides 232 that are smoothly curved, as seen in FIGS. 9-14A. Additionally, the channel 230 has a relatively constant width and depth in this embodiment. As described above, the geometry of the channel 230 can affect the flexibility of the channel 230 and the corresponding response transferred through the face 212 to the ball 106, and the channel 230 may be designed differently in other embodiments accordingly. In further embodiments, the channel 230 and the head 202 may be differently shaped and/or configured, including in any manner described herein with respect to other embodiments.

Figure 14:
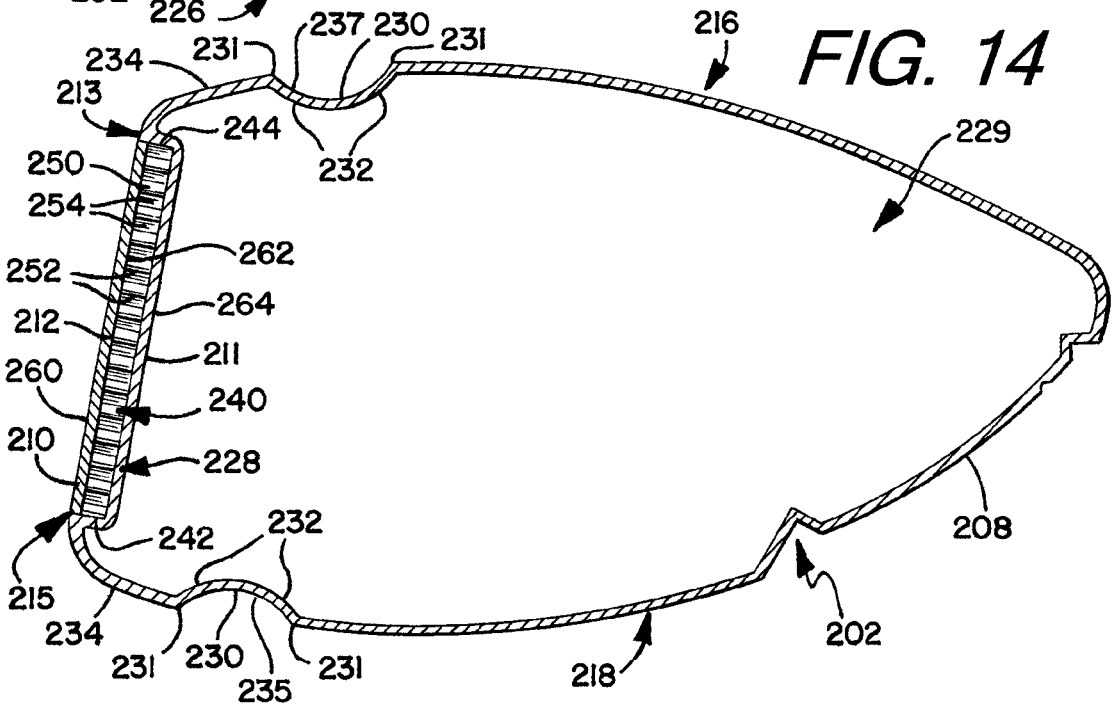
FIG. 14 is a cross-sectional view of the head of FIG. 9, taken along lines 14-14 of FIG. 12.

The face 212 in the embodiment of FIGS. 9-14A may include a stiffening structure with a cellular or other porous configuration, as similarly described above. The face 212 as illustrated in FIG. 14 includes a honeycomb cellular stiffening structure 250 similar to the face 112 of FIGS. 1-8A, formed by a plurality of structural members 252 defining symmetrical cells 254 between them in a honeycomb configuration. In other embodiments, the face 212 may include a different type of honeycomb, cellular, and/or porous stiffening structure. The face 212 illustrated in FIG. 14 further includes a face plate 260 that forms the ball striking surface 210, with the stiffening structure 250 being connected to a rear surface 262 of the face plate 260, as similarly described above. The face 212 may also include a rear plate 264 that engages or is connected to the opposite side of the stiffening structure 250, forming a sandwich structure as also described above. In this embodiment, the head 202 is formed by a face member 228 that is received in an opening 240 of a body member 229, connected along the peripheral edges 242, 244 of the face member 228 and the body member 229, as described above. As shown in FIG. 14, the rear plate 264 may be connected to the body member 229, defining the opening 240 as a recess or cavity that receives the face member 228. In another embodiment, as shown in FIG. 14B, the rear plate 264A may not cover the entire rear of the face member 228 and may form a flange or shelf 266 around the opening 240, with a gap 267 defined therein. The face member 228 may include the face plate 260, the stiffening structure 250, and optionally the rear plate 264, and may have any alternate or additional components or configurations described above.

Figure 14A:
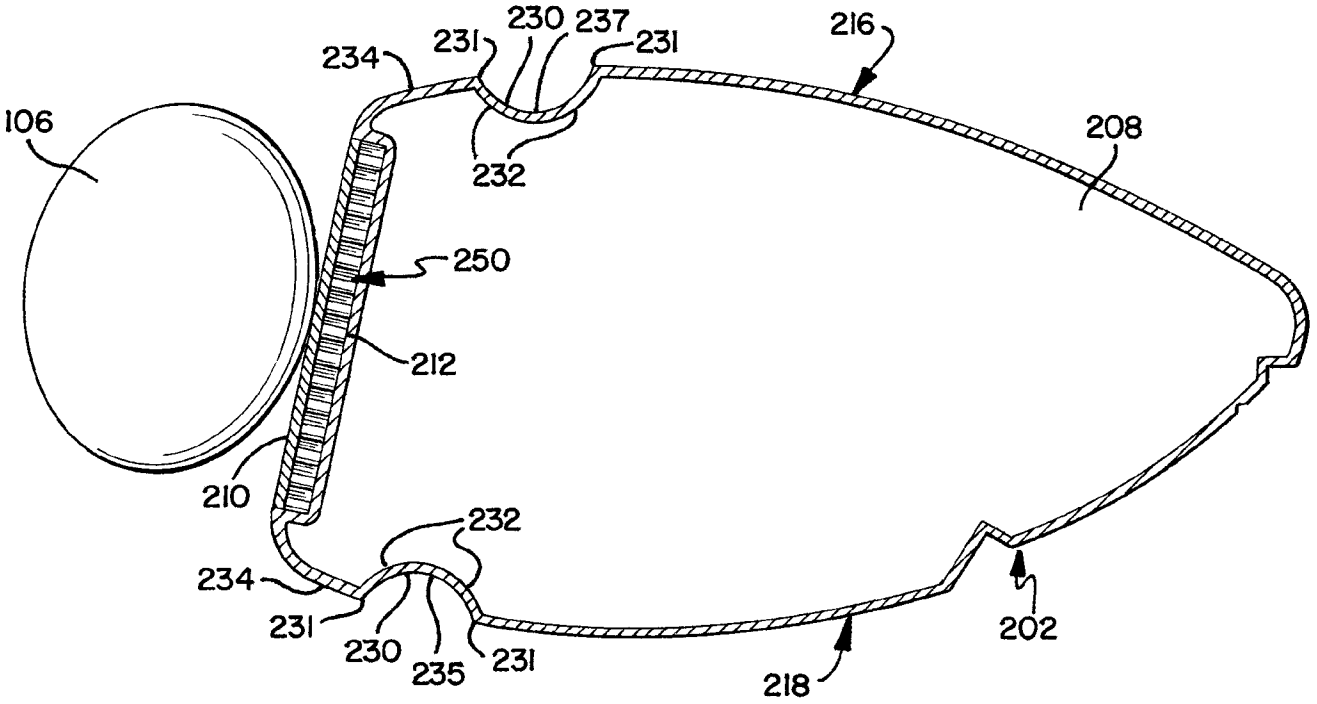
FIG. 14A is a cross-sectional view of the head as illustrated in FIG. 14, shown during an impact with a ball.
Figure 14B:
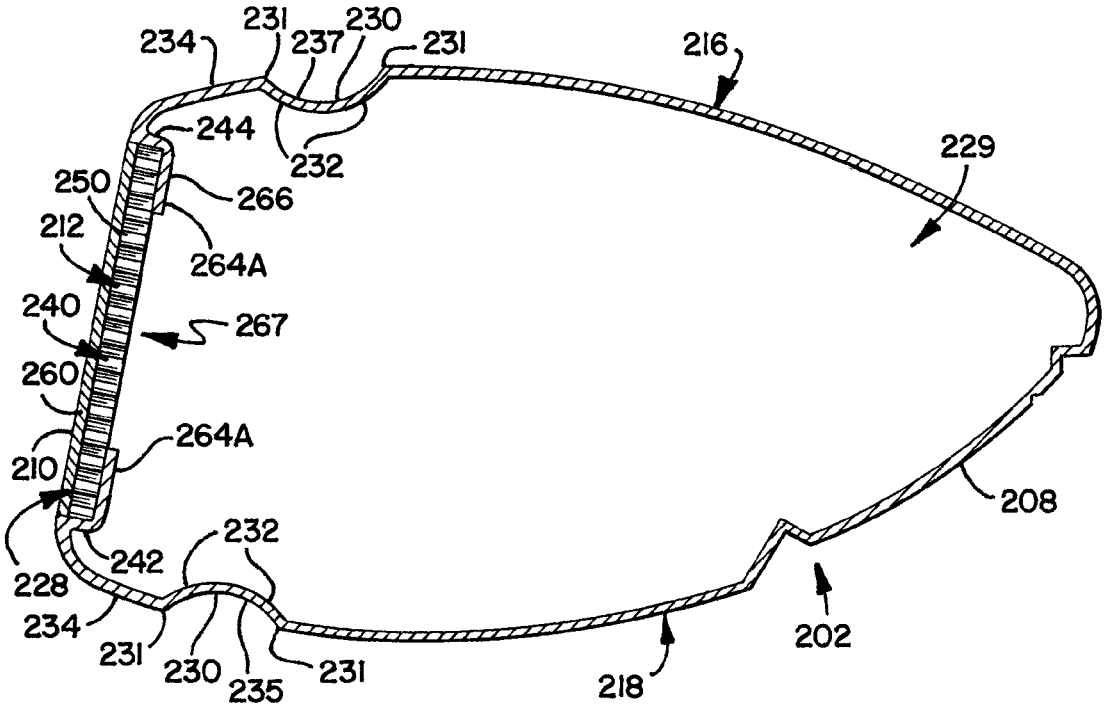
FIG. 14B is a cross-sectional view of an alternate embodiment of the head as shown in FIG. 14.
Figure 14C:
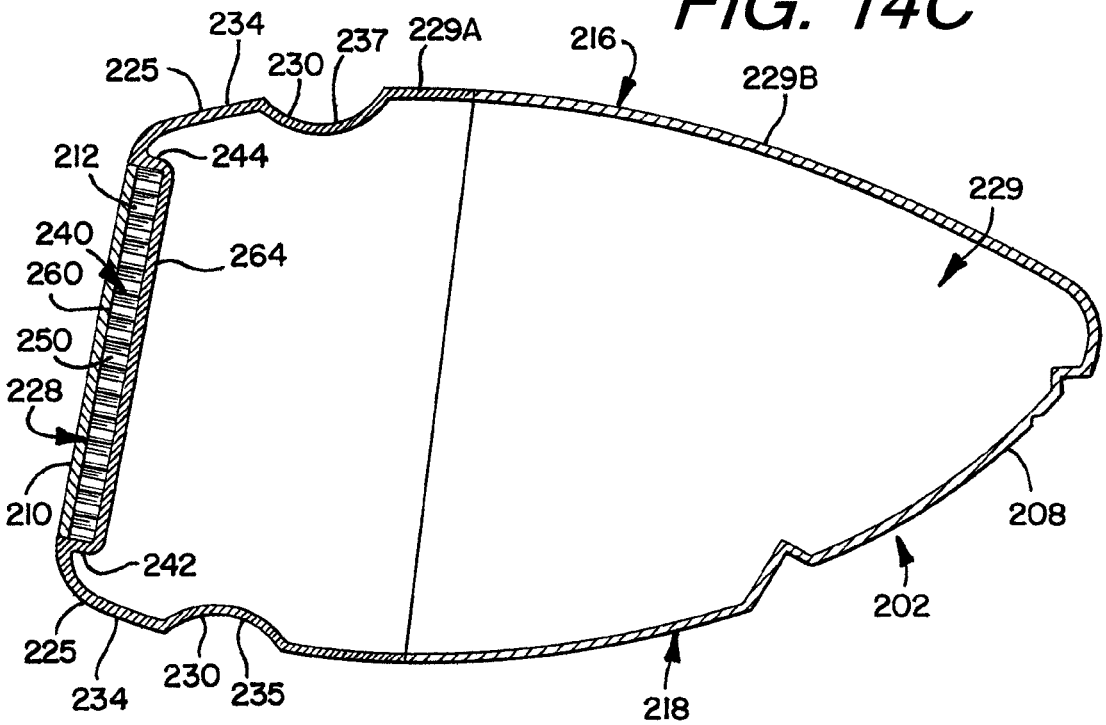
FIG. 14C is a cross-sectional view of another alternate embodiment of the head as shown in FIG. 14.

In a further embodiment, as shown in FIG. 14C, the body member 229 may be formed of two pieces, including a front piece 229A and a rear piece 229B. The front piece 229A includes walls 225 defining the opening 240 and extending rearwardly from the opening 240, as well as the rear plate 264 extending between the walls 225. The rear piece 229B is connected to the front piece 229A to further define the body 208, such as by welding or other joining technique discussed herein. In this embodiment, the channel(s) 230 are defined within the walls 225 of the front piece 229A. It is understood that a the front piece 229A may include a rear plate 264A as shown in FIG. 14B.

FIG. 14A illustrates an impact of a ball 106 on the face 212 of the head 202 as shown in FIGS. 9-14. As shown in FIG. 14A, when the ball 106 impacts the ball striking surface 210, the stiffened face 212 has very little to no deformation, and the force of the impact is transferred to the channel 230 on the body 208 of the head 202, as similarly described above with respect to FIG. 8A. The channel 230 deforms due to the impact force, as shown in FIG. 14A, and returns to its original configuration, as shown in FIG. 14, producing a response force that is transferred through the face 212 to the ball 106, propelling the ball 106 forward. The impact force and the response force are transmitted between the face 212 and the channel 230 through the spacing portion 234 positioned between the face 212 and the channel 230. The configuration shown in FIGS. 9-14A can achieve increased energy and velocity transfer to the ball 106 and increased response (COR) for impacts that are away from the center or traditional "sweet spot" of the face 212, such as high or low impacts or heel or toe impacts, as similarly described above with respect to FIG. 8A.

Figure 15:
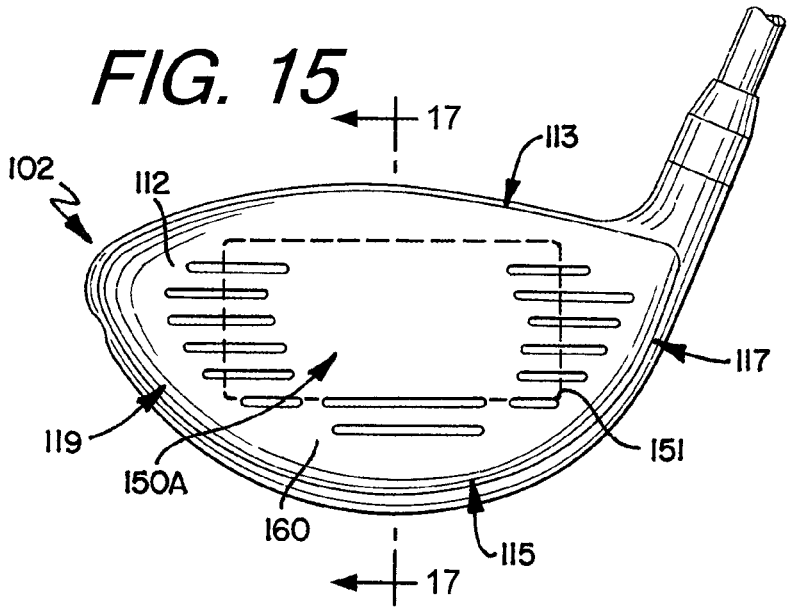
FIG. 15 is a front view of another illustrative embodiment of a head of a wood-type ball striking device according to aspects of the present invention.
Figure 16:
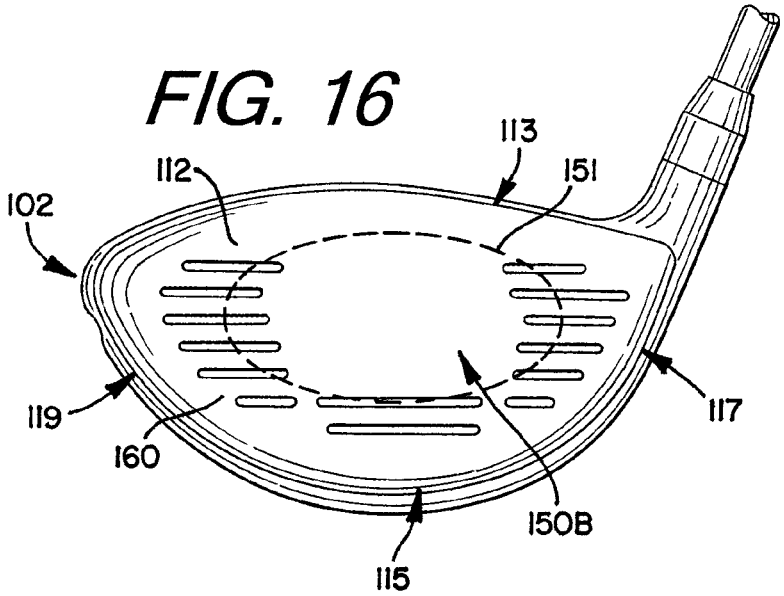
FIG. 16 is a front view of another illustrative embodiment of a head of a wood-type ball striking device according to aspects of the present invention.
Figure 17:
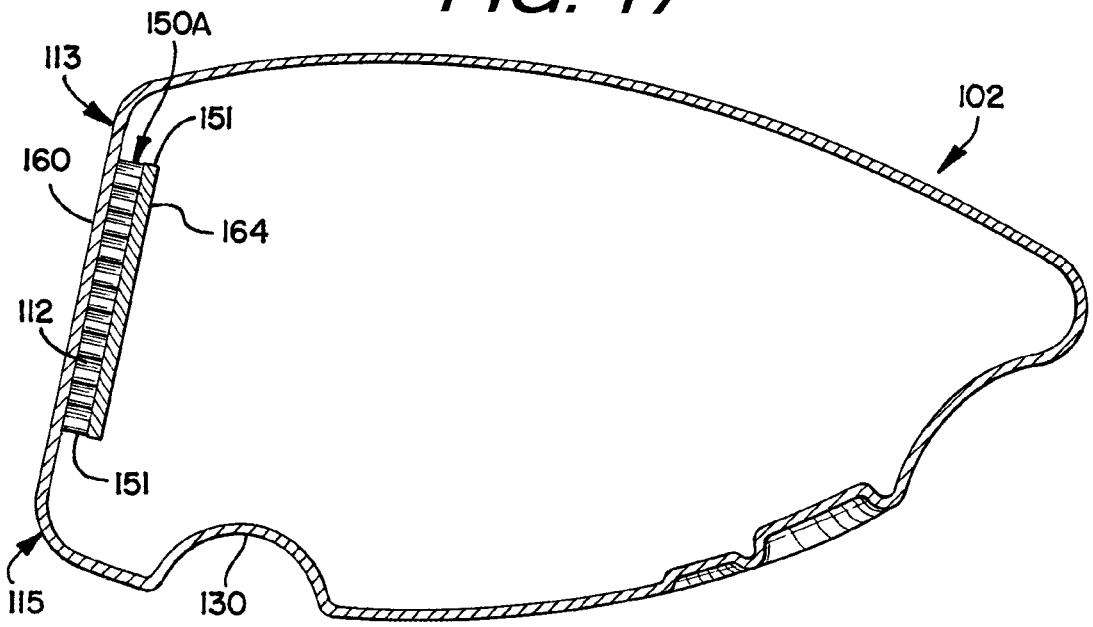
FIG. 17 is a cross-sectional view of the head of FIG. 15, taken along lines 17-17 of FIG. 15.
Figure 18:
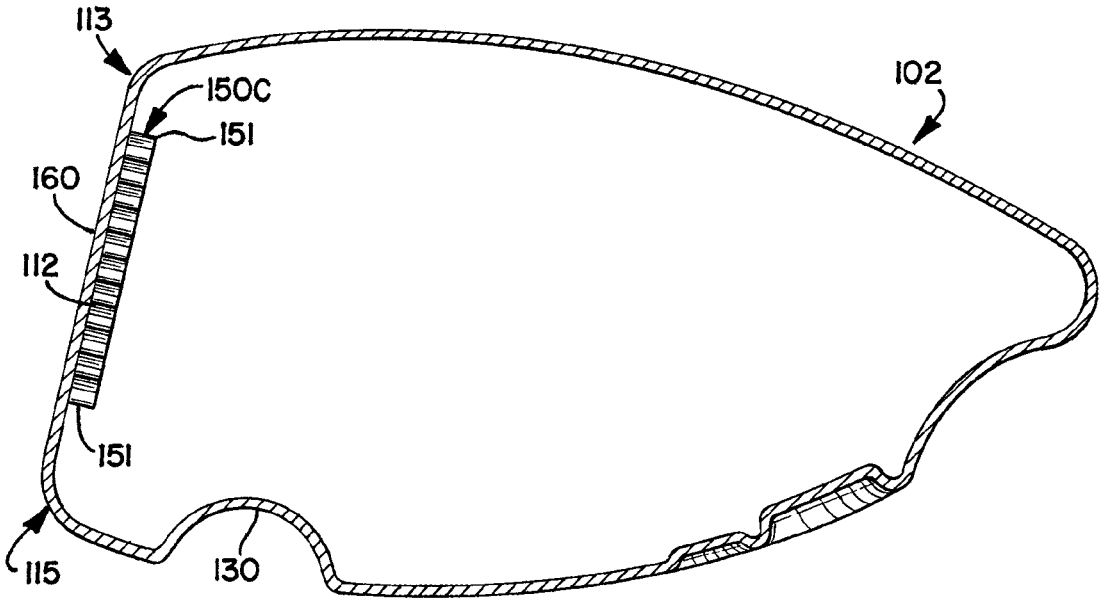
FIG. 18 is an alternate cross-sectional view of a head as illustrated in FIGS. 15 and 16, taken along lines 17-17 of FIG. 15.
Figure 17A:
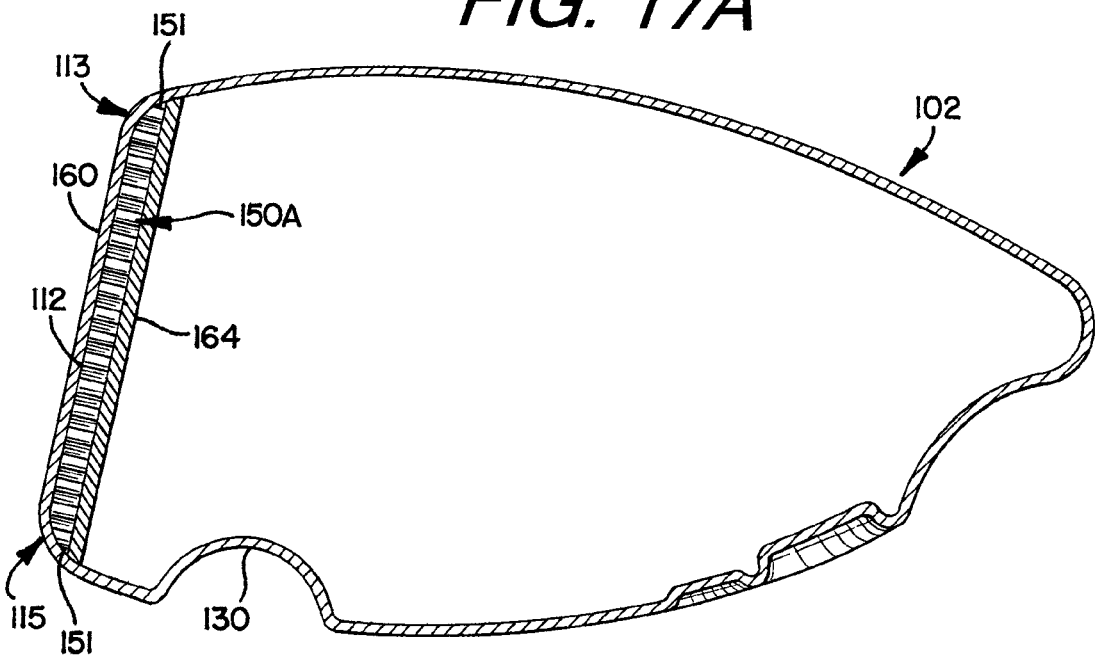
FIG. 17A is a cross-sectional view of another illustrative embodiment of a head of a wood-type ball striking device according to aspects of the present invention.
Figure 18A:
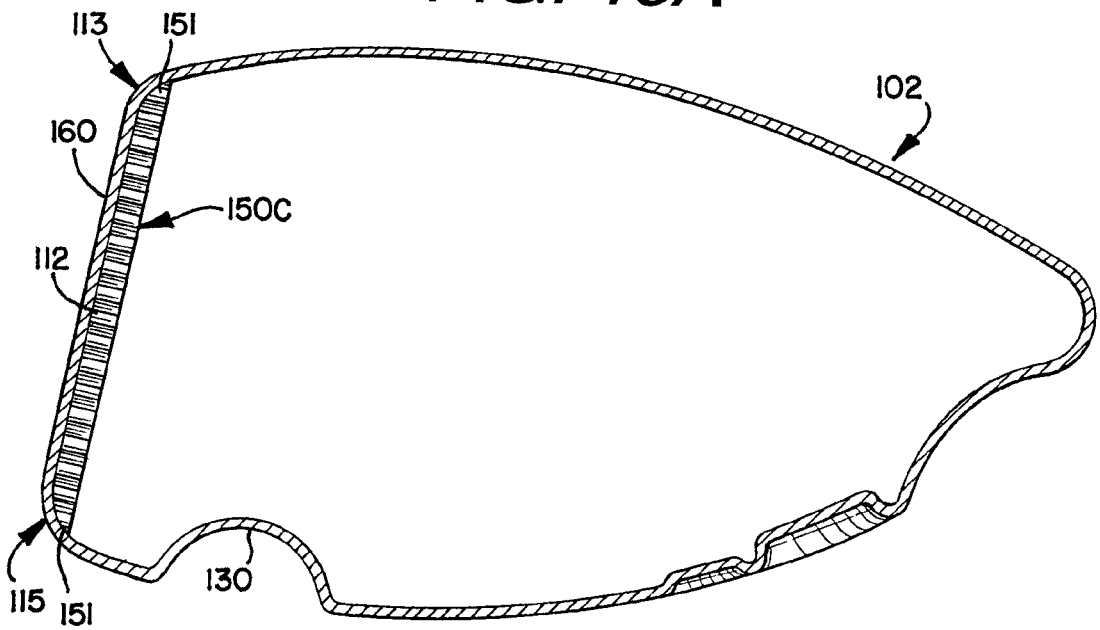
FIG. 18A is a cross-sectional view of another illustrative embodiment of a head of a wood-type ball striking device according to aspects of the present invention.

FIGS. 15-18 illustrate additional embodiments of the head 102 as shown in FIGS. 1-8A, having stiffening structures 150A-C that are configured differently from the stiffening structure 150 of FIGS. 1-8A. In the embodiments of FIGS. 15-18, the stiffening structures 150A-C do not occupy the entire expanse or area of the face 112, and the face plate 160 has larger peripheral dimensions than each stiffening structure 150A-C and occupies a larger area. In other words, the edges 151 of the stiffening structures 150A-C are retracted from the edges 113, 115, 117, 119 of the face 112 and the periphery of the face plate 160. The stiffening structures 150A-C in the embodiments illustrated are porous or cellular stiffening structures with a honeycomb configuration, as similarly described above and illustrated in FIGS. 7-8, but could be other types of stiffening structures in other embodiments. In the embodiment of FIG. 15, the stiffening structure 150A is rectangularly shaped and is centered on or around the center of gravity of the face 112. In the embodiment of FIG. 16, the stiffening structure 150B is elliptically shaped and is centered on or around the center of gravity of the face 112. FIG. 17 illustrates the embodiment of FIG. 15 in cross-section, showing the face plate 160, the stiffening structure 150A, and the rear plate 164, with the rear plate 164 having the same peripheral dimensions as the stiffening structure 150A. In another embodiment, the rear plate 164 may have peripheral dimensions that are larger or smaller than the stiffening structure 150A. In the embodiment of FIG. 18, the stiffening structure contains no rear plate 164, and the face 112 includes only the face plate 160 and the stiffening structure 150C connected thereto. It is understood that the embodiment of FIG. 16 can utilize a stiffening structure 150B that is similar to either of the configurations of the stiffening structures 150A,C in FIGS. 17-18, or another configuration. In further embodiments, as illustrated in FIGS. 17A and 18A, the head 102 may utilize a stiffening structure 150A,C similar to that shown in FIGS. 17-18, with a larger size, such that the edges 151 of the stiffening structure 150A,C extend proximate the edges 113, 115 of the face 112. In these embodiments, the stiffening structure 150A,C and optionally a rear plate 164 are connected to the rear surface 162 of the face plate 160, and the stiffening structure 150A,C and optionally the rear plate 164 extend over the entirety or the substantial entirety of the face 112.

FIGS. 19-24 illustrate additional embodiments of heads 302, 402, 502 having impact-influencing features on the body 308, 408, 508. Many features of these embodiments are similar or comparable to features of the head 102 described above and shown in FIGS. 1-8A, and such features are referred to using similar reference numerals under the "3xx," "4xx," and "5xx" series of reference numerals, rather than "1xx" as used in the embodiment of FIGS. 1-8A. Accordingly, certain features of the heads 302, 402, 502 that were already described above with respect to the head 102 of FIGS. 1-8A may be described in lesser detail, or may not be described at all. For example, although not illustrated in FIGS. 19-24, each of the heads 302, 402, 502 includes a channel 130 as shown in FIGS. 1-8A, which feature is not shown or described for sake of brevity.

Figure 19:
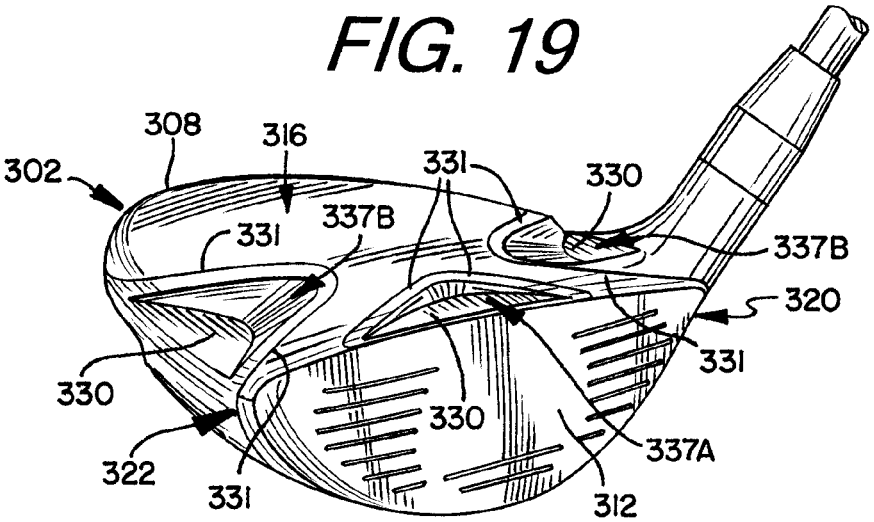
FIG. 19 is a perspective view of another illustrative embodiment of a head of a wood-type ball striking device according to aspects of the present invention.
Figure 20:
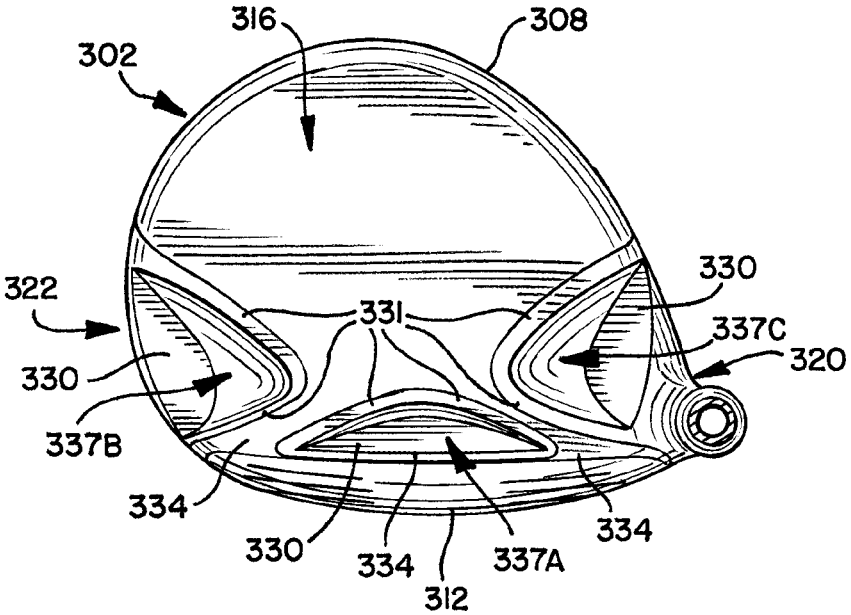
FIG. 20 is a top view of the head of FIG. 19.

The head 302 of FIGS. 19-20 includes three separate channels 330 on the crown 316, each having a periphery defined completely by boundary edges 331, so that the three channels 330 are separate and disconnected from each other and do not intersect. Each of the three channels 330 extends at least partially across the crown 316 of the head 302, forming a first crown channel portion 337A approximately centered on the geometric centerline of the head 302, a second crown channel portion 337B located proximate the heel 320, and a third crown channel portion 337C located proximate the toe 322. Each of the channels 330 are recessed from the portions of the head 302 that contact the boundary edges 331 defining the channels 330. As similarly described above with respect to other embodiments, the channels 330 are configured to deform due to impact force from an impact on the face 312 and return to their original configurations, producing a response force that is transferred through the face 312 to the ball 106. The impact force and the response force are transmitted between the face 312 and the channel (s) 330 through spacing portions 334 positioned between the face 312 and the channel(s) 330.

Figure 21:
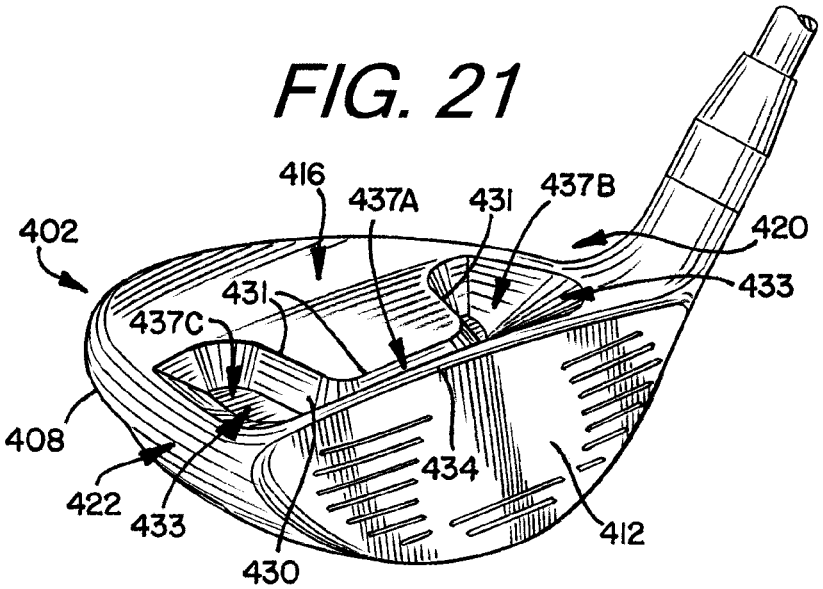
FIG. 21 is a perspective view of another illustrative embodiment of a head of a wood-type ball striking device according to aspects of the present invention.
Figure 22:
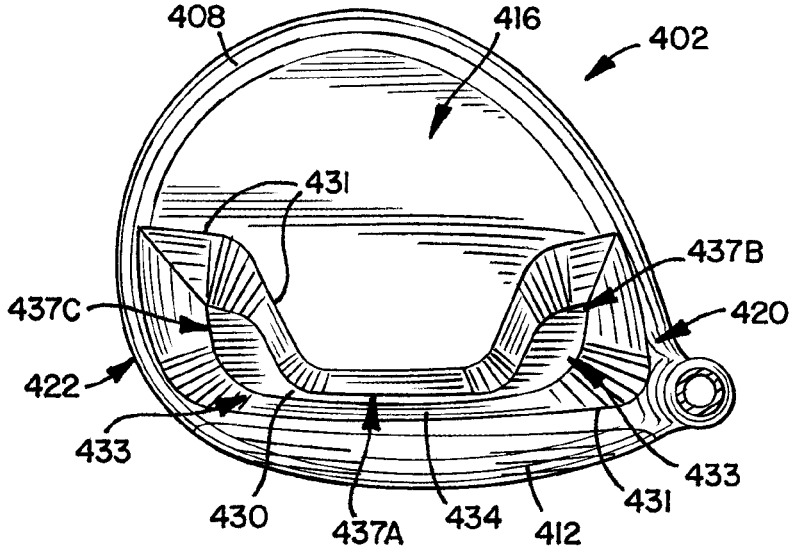
FIG. 22 is a top view of the head of FIG. 21.

The head 402 of FIGS. 21-22 includes a channel 430 on the crown 416 that is defined by boundary edges 431 and is approximately centered on the geometric centerline of the head 402. The channel 430 is recessed from the portions of the head 402 that contact the boundary edges 431 defining the channel 430. The channel 430 extends at least partially across the crown 416 of the head 402, and includes three crown channel portions or channel sections 437A-C each extending at least partially across the crown 416. The first crown channel portion or channel section 437A extends laterally between two ends 433 proximate the heel 420 and the toe 422, and the second and third crown channel portions or channel sections 437B,C extend rearwardly from the ends 433 of the first section 437A proximate the heel 420 and toe 422, respectively. As similarly described above with respect to other embodiments, the channel 430 is configured to deform due to impact force from an impact on the face 412 and return to its original configuration, producing a response force that is transferred through the face 412 to the ball 106. The impact force and the response force are transmitted between the face 412 and the channel 430 through spacing portions 434 positioned between the face 412 and the channel 430.

Figure 23:
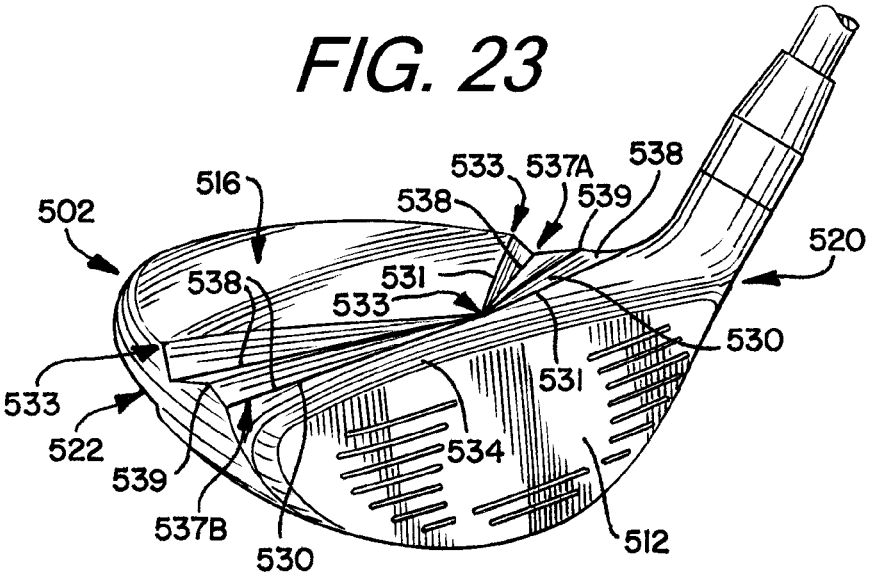
FIG. 23 is a perspective view of another illustrative embodiment of a head of a wood-type ball striking device according to aspects of the present invention.
Figure 24:
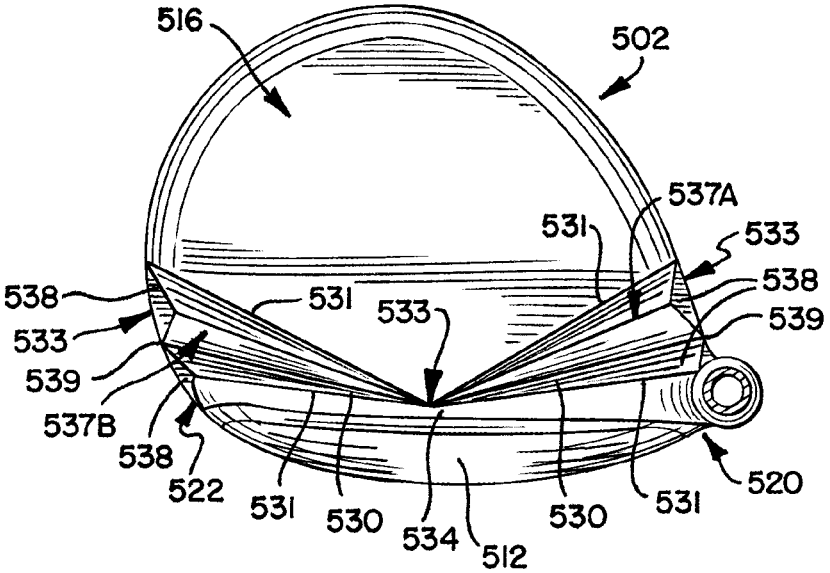
FIG. 24 is a top view of the head of FIG. 23.
Figure 25:
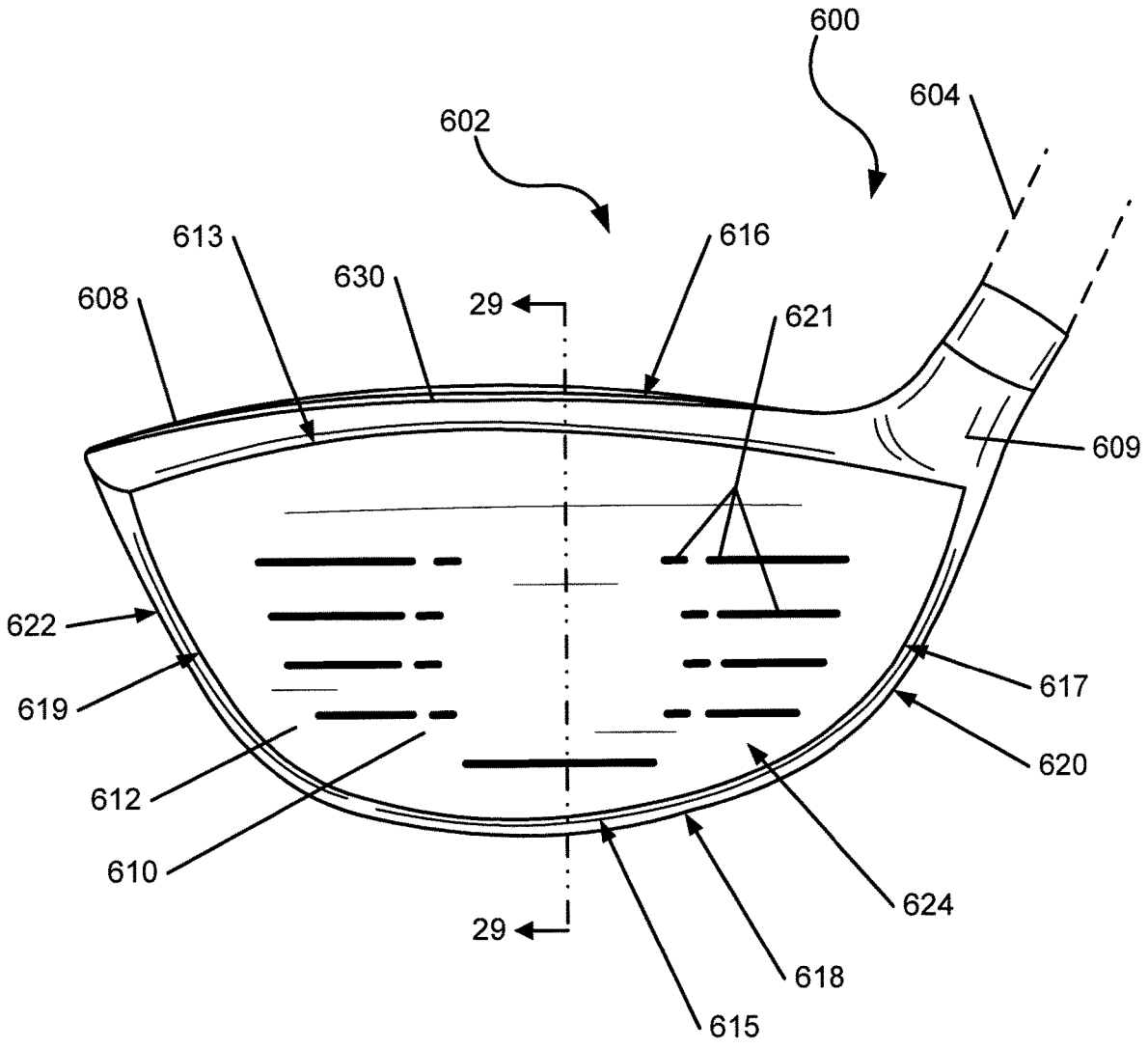
FIG. 25 is a front view of another illustrative embodiment of a head of a wood-type ball striking device according to aspects of the present invention.

The head 502 of FIGS. 23-24 includes a channel 530 on the crown 516 that is defined by boundary edges 531 and is approximately centered on the geometric centerline of the head 502. The channel 530 is recessed from the portions of the head 502 that contact the boundary edges 531 defining the channel 530. The channel 530 extends at least partially across the crown 516 of the head 502, and includes first and second crown channel portions 537A-B that each extend at least partially across the crown 516 and are connected to each other proximate the geometric centerline of the head 502. The first crown channel portion 537A extends laterally from one end 533 proximate the centerline of the head 502 to a second end 533 proximate the heel 520 and the second crown channel portion 537B extends laterally from one end 533 proximate the centerline of the head 502 to a second end 533 proximate the toe 522. Each of the crown channel portions 537A-B are tapered to increase in width traveling away from the centerline. Additionally, each of the crown channel portions 537A-B includes two recesses 538 separated by an elevated ridge 539 to form a bellows-like structure. In the embodiment shown, the ridge 539 extends to a height approximately the same as the level of the boundary edges 531, however the ridge 539 may extend to different heights in other embodiments. Further, the channel 530 may include additional recesses 538 and/or ridges 539 in other embodiments. As similarly described above with respect to other embodiments, the channel 530 is configured to deform due to impact force from an impact on the face 512 and return to its original configuration, producing a response force that is transferred through the face 512 to the ball 106. The impact force and the response force are transmitted between the face 512 and the channel 530 through spacing portions 534 positioned between the face 512 and the channel 530. It is understood that the crown channel portions 537A-B may be separately defined in another embodiment, and may be considered to form separate channels.

Any of the embodiments of FIGS. 19-24 may include additional features described herein with respect to other embodiments, including an additional channel or channels in addition to or in replacement of the channel 130 as shown in FIGS. 1-8A or similar channel(s), such as other channels described herein. In another embodiment, the heads 302, 402, 502 may include no additional channel other than the channels 330, 430, 530 illustrated in FIGS. 19-24. Further, any of the features of the embodiments of FIGS. 19-24 can be utilized in connection with other embodiments described herein.

FIGS. 25-30 illustrate another embodiment of a head 602 having impact-influencing features on the body 608. Many features of this embodiment are similar or comparable to features of the head 102 described above and shown in FIGS. 1-8A, and such features are referred to using similar reference numerals under the "6xx" series of reference numerals, rather than "1xx" as used in the embodiment of FIGS. 1-8A. Accordingly, certain features of the head 602 that were already described above with respect to the head 102 of FIGS. 1-8A may be described in lesser detail, or may not be described at all.

Figure 26:
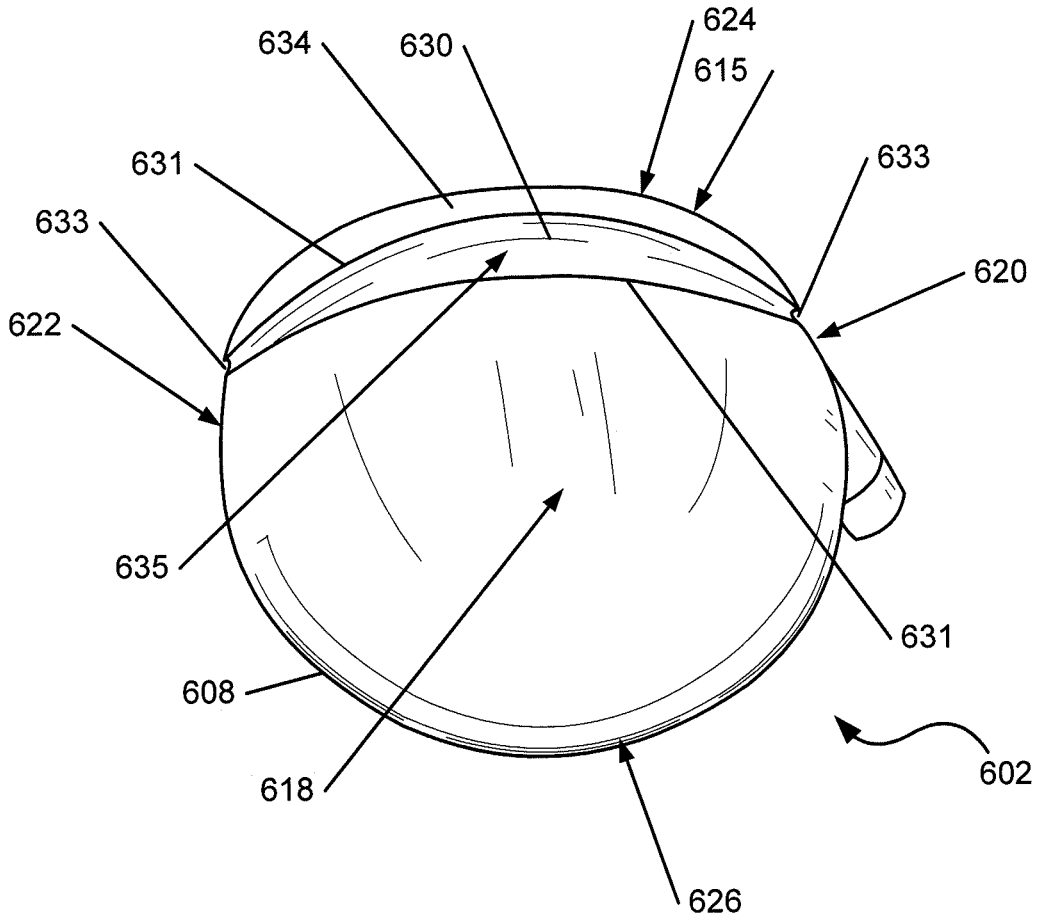
FIG. 26 is a bottom view of the head of FIG. 25.
Figure 27:
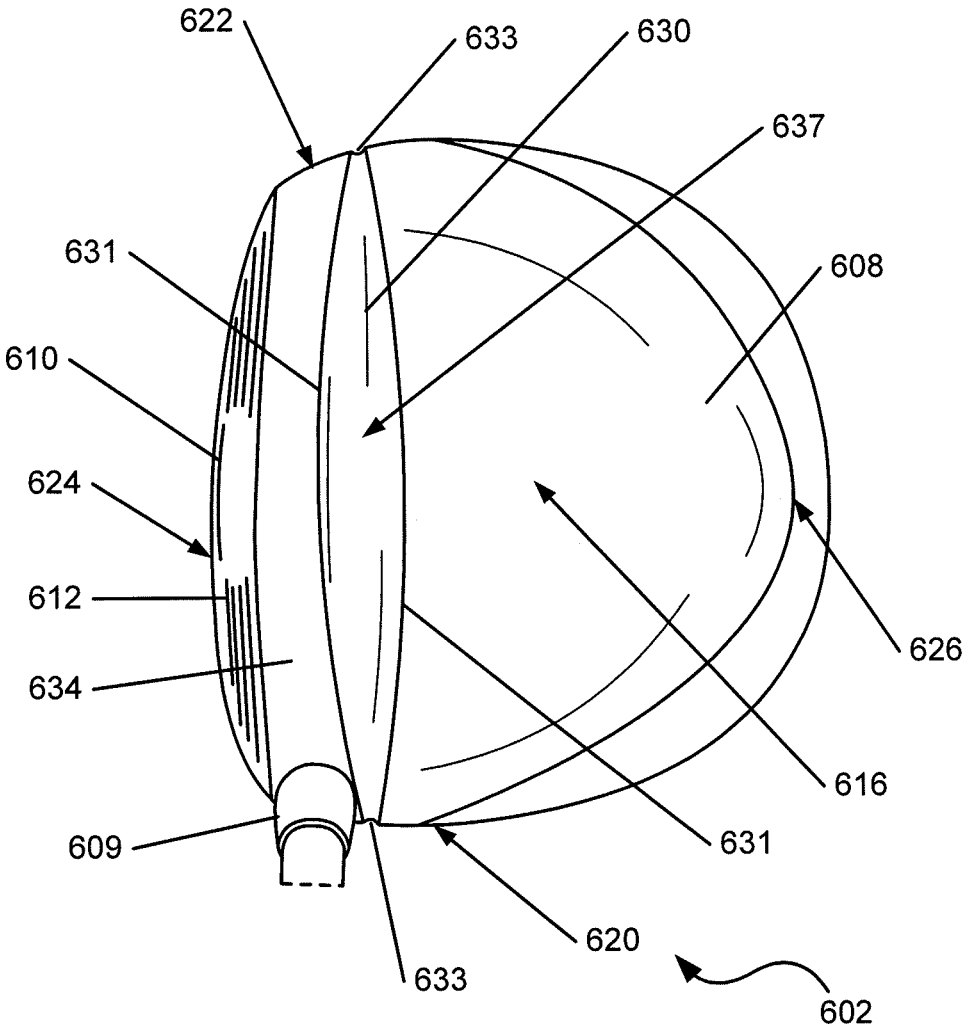
FIG. 27 is a top view of the head of FIG. 25.
Figure 27A:
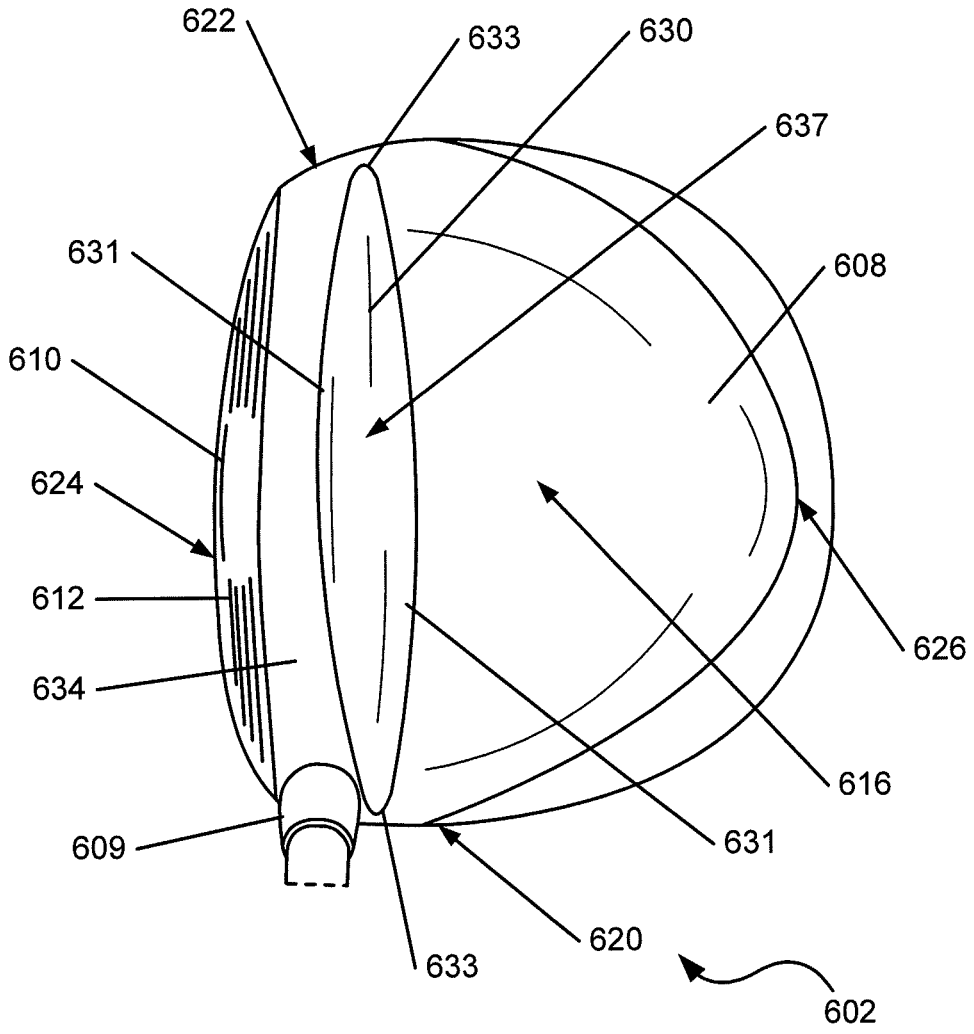
FIG. 27A is a top view of an alternative embodiment of the head of FIG. 25.
Figure 28:
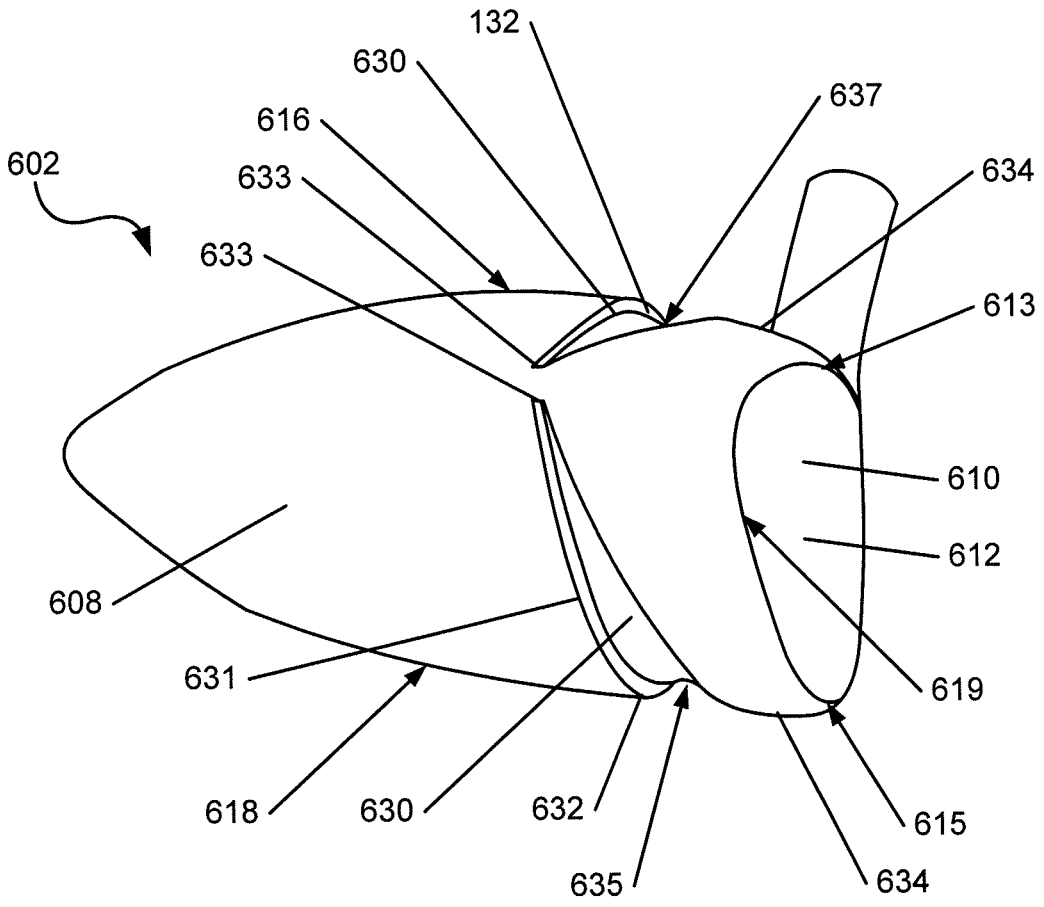
FIG. 28 is a side perspective view of the head of FIG. 25.
Figure 29:
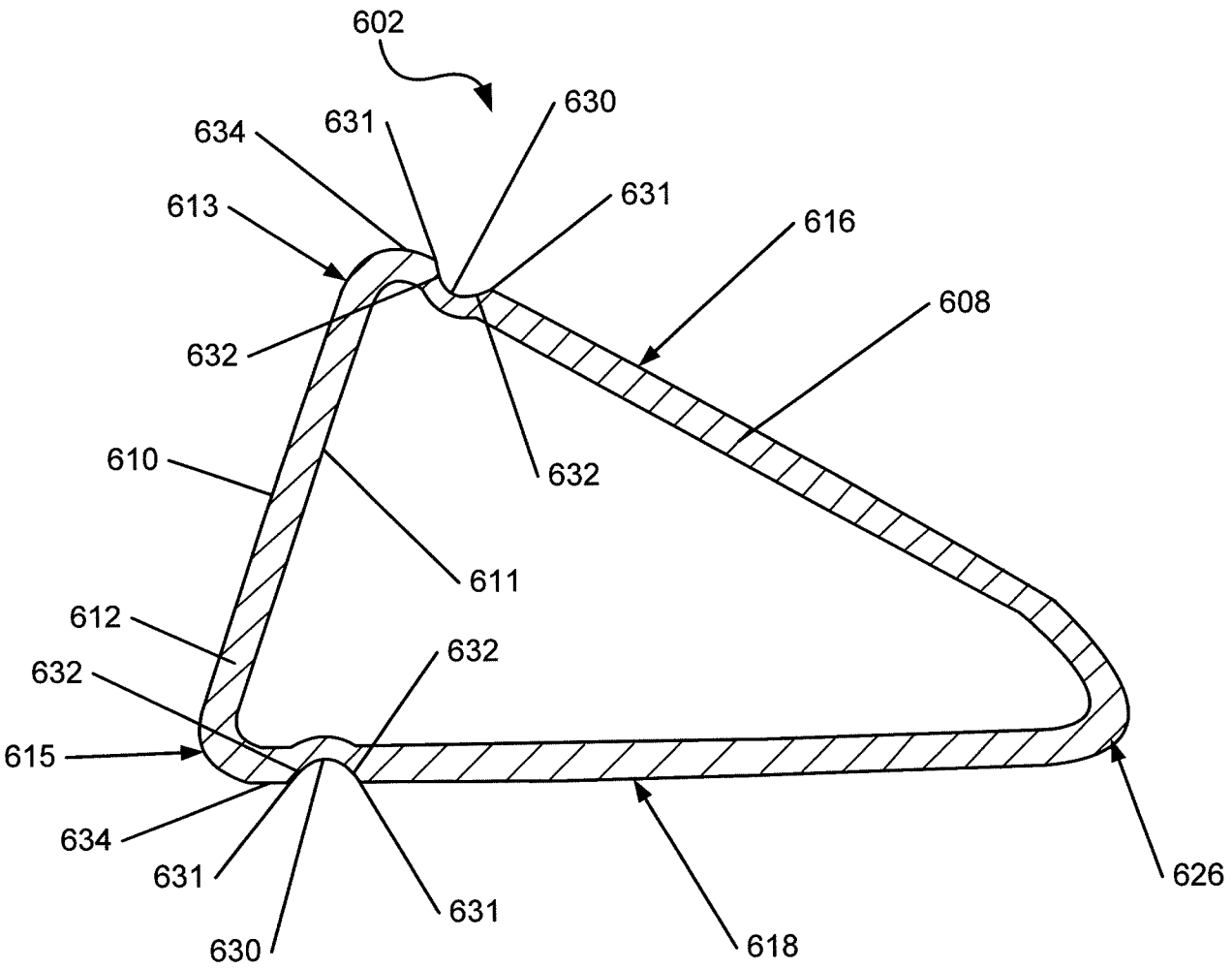
FIG. 29 is a cross-sectional view of the head of FIG. 25, taken along lines 29-29 of FIG. 25.
Figure 30:
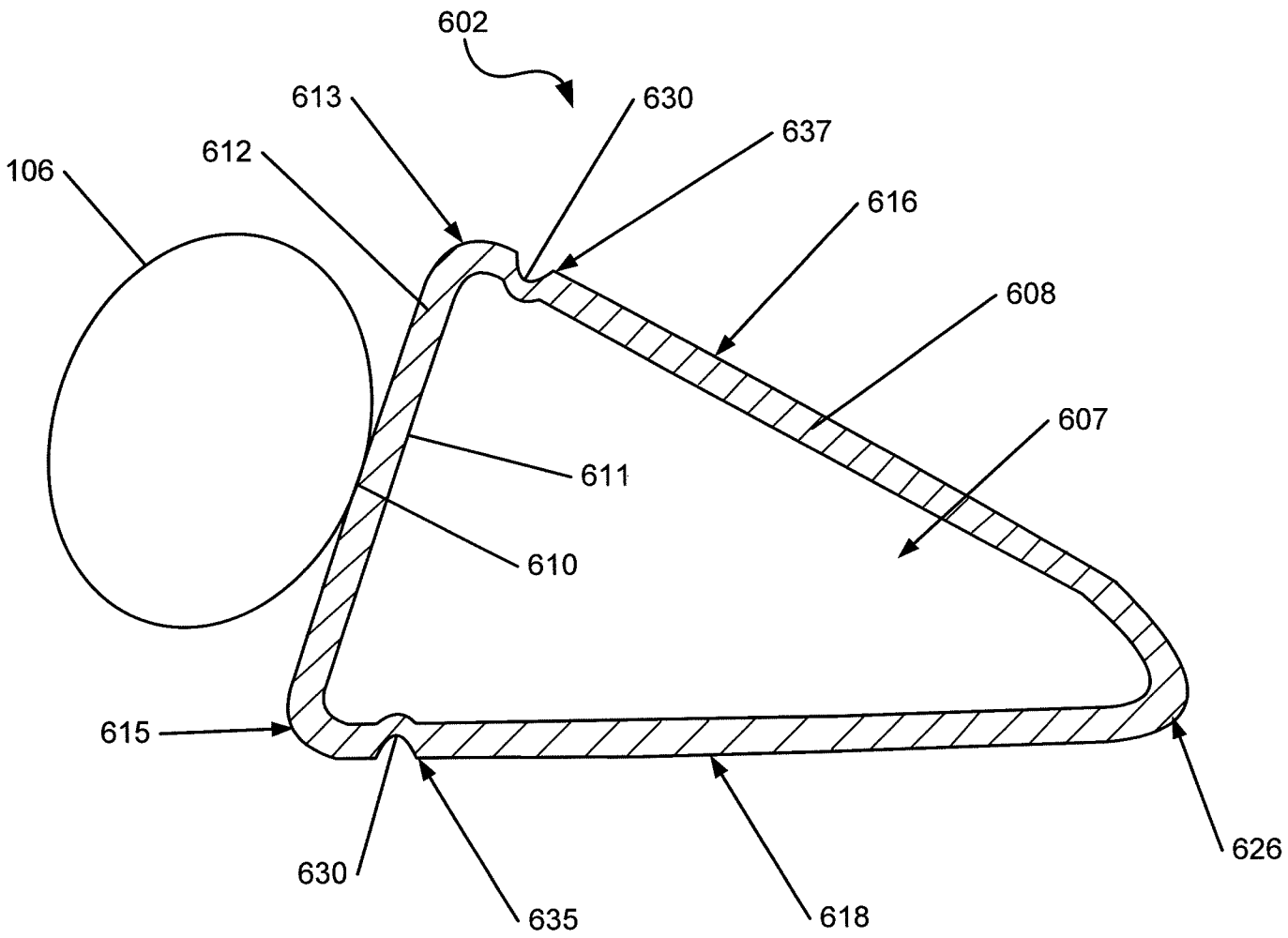
FIG. 30 is a cross-sectional view of the head as illustrated in FIG. 29, shown during an impact with a ball.

In the embodiment shown in FIGS. 25-30, the head 602 has a channel or channels 630 extending around the body 608 adjacent and generally parallel to the peripheral edges 613, 615, 617, 619 of the face 612. The channels 630 illustrated in FIGS. 25-30 allow at least a portion of the body 608 to flex, produce a reactive force, and/or change the behavior or motion of the face 612, during impact of a ball on the face 612. In this embodiment, the channels 630 permit compression and flexing of the body 608 during an impact on the face 612, and also produce a reactive force that can be transferred to the ball 106, as well as changing the motion and behavior of the face 112 during impact. As shown in FIGS. 26-28, in this embodiment, the body 608 has two elongated channels 630, one channel 630 extending laterally at least partially across the crown 616 of the head 602 to form a crown channel portion 537, and the other channel 630 extending laterally at least partially across the sole 618 of the head 602 to form a sole channel portion 635. Each of the channels 630 extends laterally from an end 633 proximate the heel 620 to an end 633 proximate the toe 622, and the two channels 630 are completely defined separately from each other by the boundary edges 631. As seen in FIGS. 28-30, the channels 630 are spaced rearwardly approximately the same distance from the face 612 by spacing portions 634, and are generally in alignment and symmetrically positioned on the head 602. It is understood that, in another embodiment, the ends of the channels shown in FIGS. 25-30 may be joined to form a single channel, such as the channel 230 of FIGS. 9-14A. In another embodiment, as shown in FIG. 27A, the top and/or bottom channels 630 may not extend to the outermost periphery (i.e. the periphery defining the largest outer dimension) of the head 602 and may converge to a point short of the outer periphery. In this embodiment, the channel 630 has distal ends 633 that stop short of the outer periphery and are spaced toward the center of the head 602 from the outer periphery, with surfaces of the body 608 extending between the ends 633 of the channel 630 and the outer periphery. In other words, the ends 633 of the channel are both on the same (top) side of the outermost periphery of the head 602, and are both on the same (top) side of a plane defined by the outermost periphery. The head 602 may contain a single channel 630 on the crown 616, a single channel on the sole 618, or channels 630 on both the crown 616 and the sole 618 in various configurations. It is understood that if the head 602 contains a channel 630 on the sole 618, this channel 630 may be similarly configured such that the ends 633 do not extend to the outer periphery of the head 602, and the ends 633 are both on the same (bottom) side of the outermost periphery.

Figure 29A:
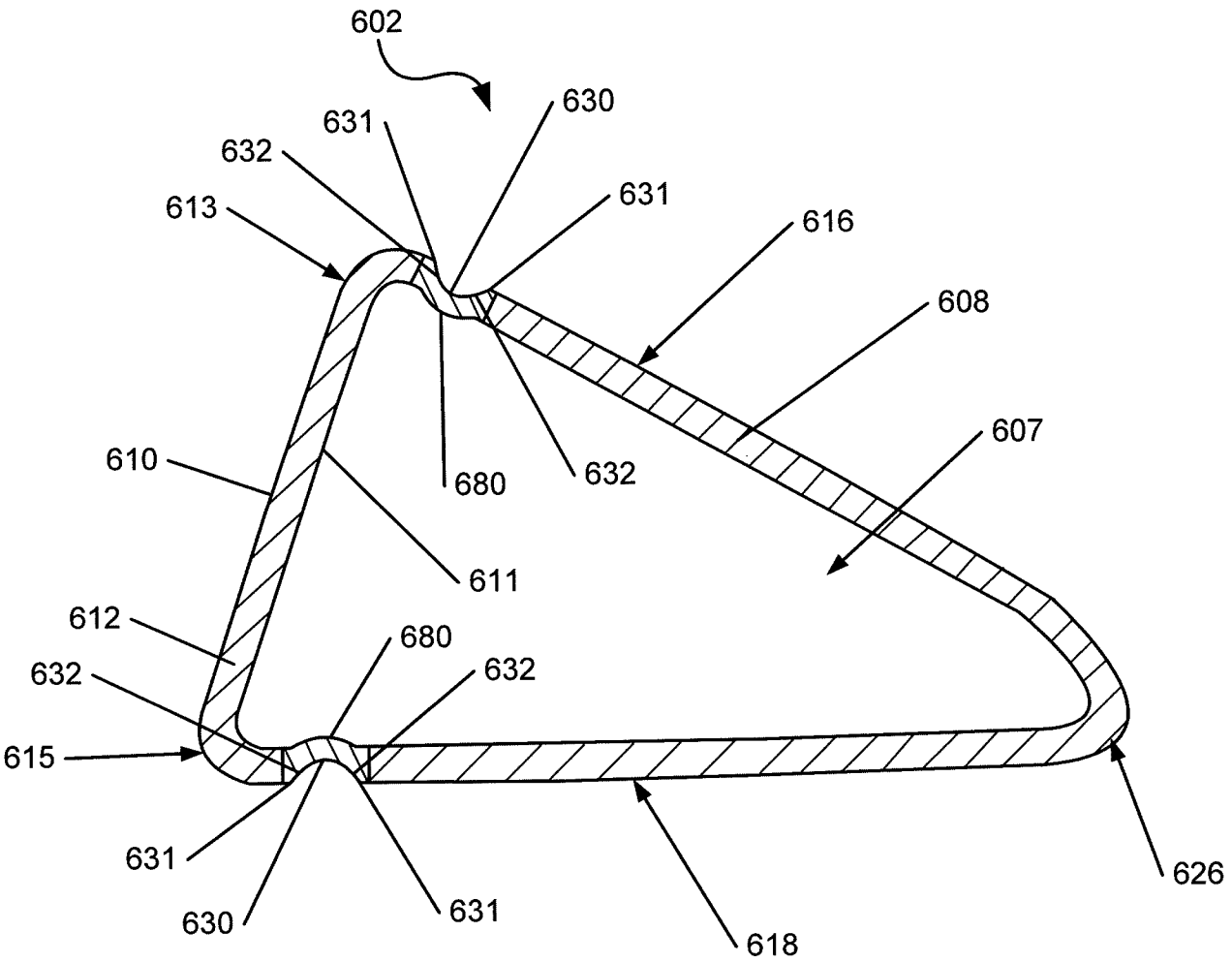
FIG. 29A is a cross-sectional view of an alternative embodiment of the head of FIG. 29.

The channels 630 illustrated in FIGS. 25-30 are recessed inwardly between the boundary edges 631 defining the channels 630, and are recessed with respect to surfaces of the head 602 that are in contact with the boundary edges 631, as shown in FIGS. 26-30. The channels 630 in this embodiment have a trough-like shape, with sloping sides 632 that are smoothly curved, as seen in FIGS. 29-30. Additionally, the channels 630 have a tapering width in this embodiment, such that the channels 630 are narrower (measured between the boundaries 631 transverse to the direction of elongation of the channel 630) at the ends 633 than at the center. The channels 630 further have a tapering depth in this embodiment, such that the channels 630 are shallower (measured by the degree of recess of the channel 630) at the ends 633 than at the center. Further, the channels 630 may be formed of a more flexible material 680 to increase the flexibility and/or responsiveness of the channel 630, as shown in FIG. 29A. The flexible material 680 may be connected to the head 602 using any technique described herein, including welding, brazing, bonding with an adhesive or other bonding material, various mechanical connections including fasteners, interlocking pieces, press-fit arrangements, joints (including lap joints, dovetail, etc.), and other configurations. The flexible material 680 may have greater flexibility than the materials of the face 612 and/or the body 608, and may include, for example, materials such as a super elasto-plastic titanium alloys ("gum metal"), vitreous alloys, metallic glasses or other amorphous metallic materials, composite materials (carbon fiber and others), or other relatively flexible metals or metal alloys.

Figure 29B:
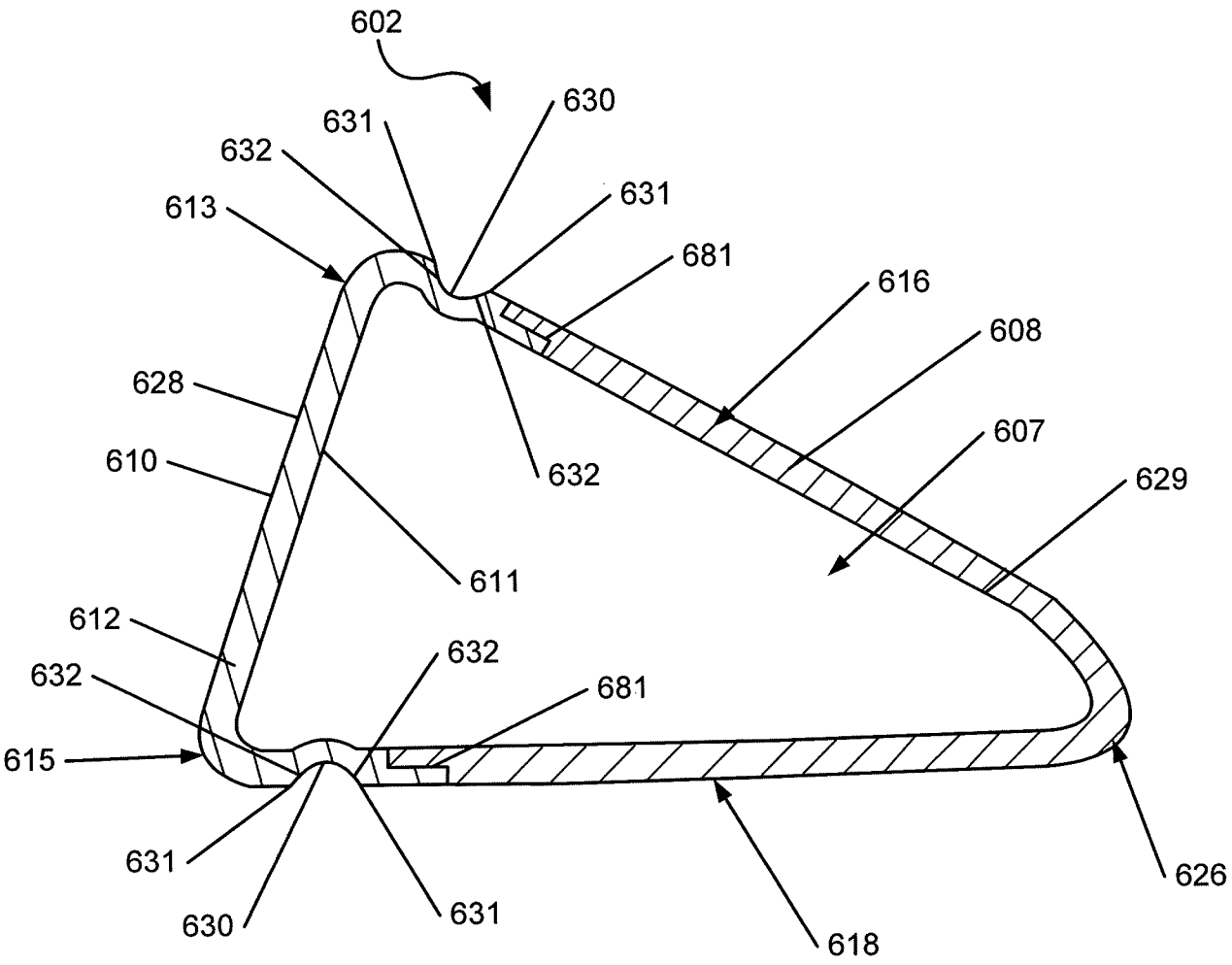
FIG. 29B is a cross-sectional view of another alternative embodiment of the head of FIG. 29.

The head 602 of FIGS. 25-30 may be formed of multiple pieces, as shown in FIG. 29A, including at least a face member 628 and a body member 629, as similarly described above. In the embodiment of FIG. 29B, the head 602 includes a face member 628 connected to a body member 629 using lap joint connections 681. It is understood that other techniques may be used to secure the lap joints 660, such as welding, brazing, bonding, press-fitting, etc. As seen in FIG. 29B, the lap joints 681 are located rearwardly of the channels 630, so as to not affect the stiffness of the channels 630 and to not result in the channels 630 being spaced too far rearwardly from the face 612. However, in another embodiment, lap joints 681 or other joint connections may be formed forwardly of the channels 630. The face member 628 shown in FIG. 29B is in the form of a cup-face structure, however other configurations of face members 628 may be used.

The face 612 in the embodiment of FIGS. 25-30 may include a stiffening structure with a cellular or other porous configuration, as similarly described above. Such stiffening structure is not illustrated in FIGS. 25-30, and may include any of the stiffening structures described above, such as the stiffening structures 150, 150A-C, 250 shown in FIGS. 1-18 and described above. In other embodiments, the face 612 may include a different type of honeycomb, cellular, and/or porous stiffening structure. FIG. 30 illustrates an impact of a ball 106 on the face 612 of the head 602 as shown in FIGS. 25-29. As shown in FIG. 30, when the ball 106 impacts the ball striking surface 610, the stiffened face 612 has very little to no deformation, and the force of the impact is transferred to the channels 630 on the body 608 of the head 602, as similarly described above with respect to FIGS. 8A and 14A. The channels 630 deform due to the impact force, as shown in FIG. 30, and return to their original configurations, as shown in FIG. 29, producing a response force that is transferred through the face 612 to the ball 106, propelling the ball 106 forward. The impact force and the response force are transmitted between the face 612 and the channels 630 through the spacing portions 634 positioned between the face 612 and the channels 630. The configuration shown in FIGS. 25-30 can achieve increased energy and velocity transfer to the ball 106 and increased response (COR) for impacts that are away from the center or traditional "sweet spot" of the face 612, such as high or low impacts or heel or toe impacts, as similarly described above with respect to FIGS. 8A and 14A.

Figure 32:
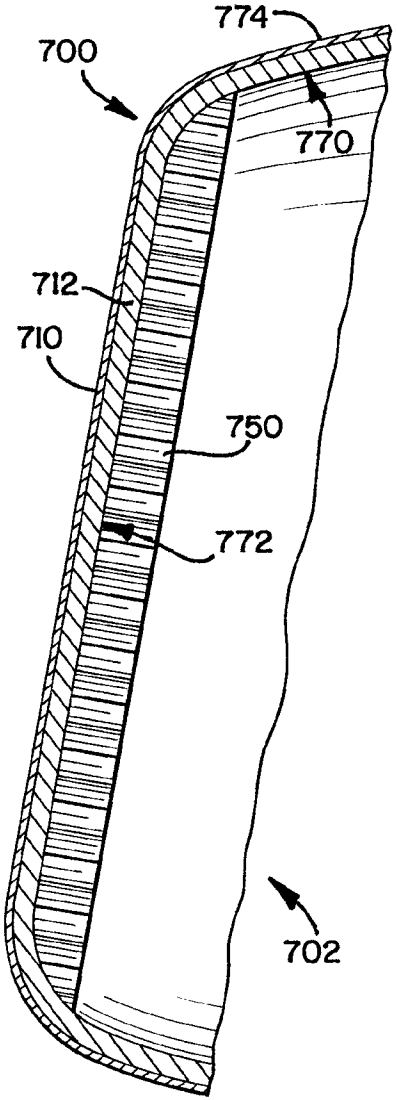
FIG. 32 is a partial cross-sectional view of another illustrative embodiment of a head of a wood-type ball striking device according to aspects of the present invention.

FIG. 32 illustrates a partial cross-sectional view of another alternative embodiment of a ball striking device of the present invention, generally designated with the reference numeral 700. The ball striking device 700 includes a golf club head 702 and has a cup-shaped body member 770 defining an inner surface 772. A honeycomb cellular stiffening member 750 extends from the inner surface 772 and is integrally formed with the body member 770. The honeycomb member 750 extends generally from the entire inner surface 772 of the body member 770 in an exemplary embodiment. The honeycomb member 750 has a plurality of cells and may be dimensioned and structured similarly to the honeycomb structure described above. The honeycomb member 750 provides similar benefits as described herein. In one exemplary embodiment, the body member 770 is formed from a bulk molding compound (BMC). The body member 770 may also be formed from other types of materials, including other reinforced polymers and resins. The bulk molding compound is selected to have suitable strength and other properties as described herein. The bulk molding compound may be formed into the body member 770 in a thermosetting injection molding process wherein the honeycomb member 750 is integrally formed with the body member 770. While a portion of the golf club head 702 is shown in FIG. 32, it is understood that various other portions of the club head 702 (e.g. a club head body) can be connected to the body member 770. The other portions may, if desired, include any of the various features of the device as described herein including the channel structures. The other portions of the club head 702 may also be formed from a variety of materials as desired.

In some examples, a coating material, such as a nano-coating in one embodiment, may cover the body member 770 and may aid in connecting various portions of the golf club head 702. Nano-coatings have been described as "liquid solids" composed of extremely small particles. The nano-coatings may be extremely flexible, resistant to corrosion, abrasion or scratching, and may require substantially less time to cure than conventional coatings. For instance, some types of nano-coatings may be cured in 10 seconds or less, as opposed to 30 minutes or more for various conventional coatings. The nano-coating may be applied to the body member 770 or golf club head 702 using known methods of application, such as painting, spraying, etc. Some suitable nano-coatings may include those having nickel, iron or zinc particles. As mentioned above, the nano-coating may be an outer coating that may provide a uniform, one piece appearance for the golf club head 702. In some arrangements, the nano-coating may provide the appearance of a golf club head 700 made entirely of metal or another single material.

In particular, the club head 770 has a coating member or coating material 774 thereon, in the form of a nano-coating. As shown in FIG. 32, the coating member 774 is positioned over the body member 770 and forms the ball-striking surface 710 of a face 712 of the device 700. It is understood that the nano-coating member could be deposited on the body member 770 in other structural configurations. It is further understood that the dimensions of the body member 770 and coating member 774 are not necessarily drawn to scale. The relative thicknesses of the members 770,774 can vary as desired.

The construction of the ball striking device 700 shown in FIG. 32 can provide a lightweight device while having enhanced strength. The coating member 774 assists in providing a strong ball striking surface 710 and further provides a look of a device fully made from metal materials. It is understood that various features and constructions of the various other embodiments described herein may be combined or otherwise utilized with the ball striking device 700 shown in FIG. 32.

Figure 33:
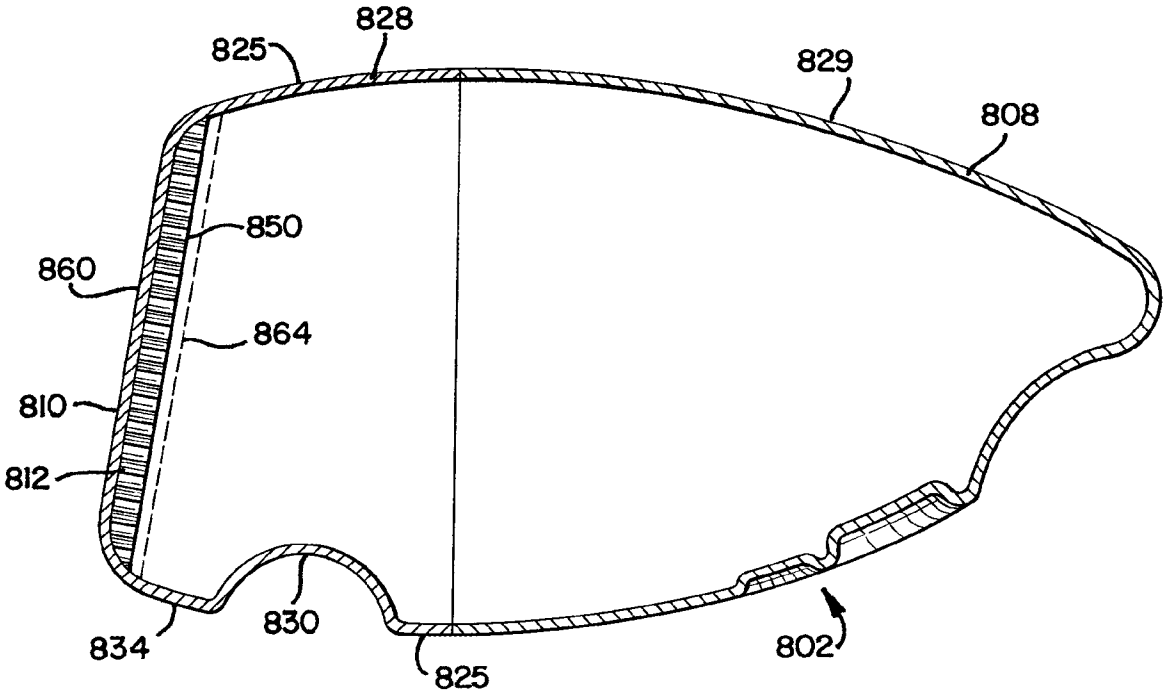
FIG. 33 is a cross-sectional view of another illustrative embodiment of a head of a wood-type ball striking device according to aspects of the present invention.

FIG. 33 illustrates another embodiment of a head 802 for a ball striking device according to the present invention. Many features of this embodiment are similar or comparable to features of the head 102 described above and shown in FIGS. 1-8A, and such features are referred to using similar reference numerals under the "8xx" series of reference numerals, rather than "1xx" as used in the embodiment of FIGS. 1-8A. Accordingly, certain features of the head 802 that were already described above with respect to the head 102 of FIGS. 1-8A may be described in lesser detail, or may not be described at all. In this embodiment, the head 802 is formed of multiple pieces and includes at least a face member 828 and a body member 829 connected to the face member 828, as similarly described above. The face member 828 includes the face plate 860 and walls 825 extending rearwardly from the face plate 860 to form a cup-face structure. The stiffening structure 850 is connected to the rear of the face plate 860, such as by welding, brazing, bonding with an adhesive or other bonding material, or other technique described herein. A rear plate 864 may optionally be connected to the stiffening structure 850, as shown in broken lines in FIG. 33. As seen in FIG. 33, the channel 830 and the spacing portion 834 are located in the walls 825 and the connection between the face member 828 and the body member 829 is located rearwardly of the channel 830, so as to not affect the stiffness of the channel 830 and to not result in the channel 830 to be spaced too far rearwardly from the face 812. However, in another embodiment, the channel 830 may be located on the body member 829, such as if the juncture between the face member 828 and the body member 829 is within the spacing portion 834. If the face member 828 is welded to the body member 829, a butt joint may be used instead of a lap joint. Additionally, it may be advantageous to weld in a location where the heat affected zone (HAZ) of the weld does not penetrate the channel 830 and/or affect the flexibility of the channel 830. In one embodiment, the weld is no closer than about 4 mm from the channel 830. It is understood that the head 802 may include multiple channels 830 or a 360° channel 830 in other embodiments. It is further understood that other configurations of face members 828 or body members 829 may be used, including members having different shapes and/or multiple pieces.

Several different embodiments have been described above, including the various embodiments of golf clubs 100 and heads 102, 202, 302, 402, 502, 602, 702 (referred to herein as 102, et seq.) and portions thereof described herein. It is understood that any of the features of these various embodiments may be combined and/or interchanged. For example, as described above, various different combinations of club heads 102, et seq., with differently configured faces 112, et seq., may be used, including the configurations described herein, variations or combinations of such configurations, or other configurations. In one particular example, any of the club heads 102, et seq., described herein may include face stiffening features and/or impact-influencing body features as described above. In further embodiments, at least some of the features described herein can be used in connection with other configurations of iron-type clubs, wood-type clubs, other golf clubs, or other types of ball-striking devices.

Heads 102, et seq., incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head 102, et seq., according to features and embodiments described herein.

The ball striking devices and heads therefor as described herein provide many benefits and advantages over existing products. For example, as described above, the impact between the ball and the face can provide a high degree of response (COR), energy transfer, and ball velocity for impacts occurring away from the center of the face, such as high, low, heel, and toe impacts, as compared to existing club heads, because the face does not depend on localized "trampoline" effect for response force. Further, the embodiments described herein having a porous or cellular stiffening structure can achieve mass savings in the face, which allows for additional mass that can be strategically placed on the body to affect the center of gravity, weight distribution, and/or MOI of the club head. Still other benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head comprising:

a face having a ball striking surface and being defined by a peripheral edge;

a body connected to the face and extending rearward from the face to define an enclosed volume, the body having a front side, a rear side, a heel side, a toe side, a crown, and a sole;

a first channel located on a surface of the body, the first channel having a periphery defined by boundary edges, wherein the boundary edges include a front edge extending laterally along the peripheral edge of the face between a heel end and a toe end of the first channel, such that the heel end and the toe end are located on opposite sides of a geometric centerline of the body, and the boundary edges further include a rear edge located further rearwardly than the front edge, wherein the first channel extends from the front edge to the rear edge, and the first channel has a width measured in a front-to-rear direction between the front and rear edges, wherein the rear edge includes a heel portion extending forward to the front edge and toward the heel side of the body at a first angle to the front edge, such that the first channel tapers to a first point formed by the heel portion and the front edge at the heel end of the first channel, and the rear edge further includes a toe portion extending toward the front edge and toward the toe side of the body at a second angle to the front edge, such that the first channel tapers to a second point formed by the toe portion and the front edge at the toe end of the first channel.

2. The golf club head of claim 1, wherein the first channel is greatest along the geometric centerline of the body.

3. The golf club head of claim 1, wherein the first channel is formed by recessed surfaces of the body that are recessed between the boundary edges.

4. The golf club head of claim 1, wherein the first channel has a wall thickness that is smaller than a wall thickness of the body adjacent the first channel.

5. The golf club head of claim 1, wherein the heel portion and the toe portion of the rear edge meet at a widest portion of the first channel.

6. The golf club head of claim 1, wherein the first channel is located more proximate to the face than to the rear side of the body.

7. The golf club head of claim 1, further comprising:

a heel channel located on the surface of the body, the heel channel having a second periphery defined by second boundary edges, wherein the heel channel is located between the heel side of the body and the geometric centerline of the body, wherein the boundary edges of the first channel and the second boundary edges of the heel channel are disconnected and separated from each other by a heel spacing portion separating the first channel from the heel channel.

8. The golf club head of claim 7, further comprising:

a toe channel located on the surface of the body, the toe channel having a third periphery defined by third boundary edges, wherein the toe channel is located between the toe side of the body and the geometric centerline of the body, wherein the boundary edges of the first channel and the third boundary edges of the toe channel are disconnected and separated from each other by a toe spacing portion separating the first channel from the toe channel.

9. The golf club head of claim 8, wherein the heel spacing portion extends toward the face and toward the heel side of the body in a first direction that is angled with respect to the geometric centerline of the body, and the toe spacing portion extends toward the face and toward the toe side of the body in a second direction that is angled with respect to the geometric centerline of the body.

10. The golf club head of claim 7, wherein the heel spacing portion extends toward the face and toward the heel side of the body in a direction that is angled with respect to the geometric centerline of the body.

11. The golf club head of claim 1, further comprising:

a toe channel located on the surface of the body, the toe channel having a third periphery defined by third boundary edges, wherein the toe channel is located between the toe side of the body and the geometric centerline of the body, wherein the boundary edges of the first channel and the third boundary edges of the toe channel are disconnected and separated from each other by a toe spacing portion separating the first channel from the toe channel.

12. The golf club head of claim 11, wherein the toe spacing portion extends toward the face and toward the toe side of the body in a direction that is angled with respect to the geometric centerline of the body.

13. The golf club head of claim 1, wherein the heel portion and the toe portion of the rear edge are also angled with respect to the geometric centerline of the body.

14. The golf club head of claim 1, wherein the heel and toe portions of the rear edge form acute angles with the front edge.

15. A golf club head comprising:

a face having a ball striking surface and being defined by a peripheral edge;

a body connected to the face and extending rearward from the face to define an enclosed volume, the body having a front side, a rear side, a heel side, a toe side, a crown, and a sole;

a first channel located on a surface of the body, the first channel having a periphery defined by boundary edges, wherein the boundary edges include a front edge extending laterally along the peripheral edge of the face between a heel end and a toe end of the first channel, such that the heel end and the toe end are located on opposite sides of a geometric centerline of the body, and the boundary edges further include a rear edge located further rearwardly than the front edge, wherein the first channel has a width measured in a front-to-rear direction between the front and rear edges;

a heel channel located on the surface of the body, the heel channel having a second periphery defined by second boundary edges, wherein the heel channel is located between the heel side of the body and the geometric centerline of the body, wherein the boundary edges of the first channel and the second boundary edges of the heel channel are disconnected and separated from each other by a heel spacing portion separating the first channel from the heel channel; and a toe channel located on the surface of the body, the toe channel having a third periphery defined by third boundary edges, wherein the toe channel is located between the toe side of the body and the geometric centerline of the body, wherein the boundary edges of the first channel and the third boundary edges of the toe channel are disconnected and separated from each other by a toe spacing portion separating the first channel from the toe channel, wherein the rear edge includes a heel portion extending toward the front edge and toward the heel side of the body at a first angle to the front edge, such that the first channel tapers to a first point at the heel end of the first channel, and the rear edge further includes a toe portion extending toward the front edge and toward the toe side of the body at a second angle to the front edge, such that the first channel tapers to a second point at the toe end of the first channel, and wherein the heel spacing portion extends toward the face and toward the heel side of the body in a first direction that is angled with respect to the geometric centerline of the body, and the toe spacing portion extends toward the face and toward the toe side of the body in a second direction that is angled with respect to the geometric centerline of the body.

16. A golf club head comprising:

a face having a ball striking surface and being defined by a peripheral edge;

a body connected to the face and extending rearward from the face to define an enclosed volume, the body having a front side, a rear side, a heel side, a toe side, a crown, and a sole;

a first channel located on a surface of the body, the first channel having a periphery defined by boundary edges, wherein the boundary edges include a front edge extending laterally along the peripheral edge of the face between a heel end and a toe end of the first channel, such that the heel end and the toe end are located on opposite sides of a geometric centerline of the body, and the boundary edges further include a rear edge located further rearwardly than the front edge, wherein the first channel has a width measured in a front-to-rear direction between the front and rear edges; and a heel channel located on the surface of the body, the heel channel having a second periphery defined by second boundary edges, wherein the heel channel is located between the heel side of the body and the geometric centerline of the body, wherein the boundary edges of the first channel and the second boundary edges of the heel channel are disconnected and separated from each other by a heel spacing portion separating the first channel from the heel channel, wherein the rear edge includes a heel portion extending toward the front edge and toward the heel side of the body at a first angle to the front edge, such that the width of the first channel tapers to a first point at the heel end of the first channel, and the rear edge further includes a toe portion extending toward the front edge and toward the toe side of the body at a second angle to the front edge, such that the width of the first channel tapers to a second point at the toe end of the first channel, and wherein the heel spacing portion extends toward the face and toward the heel side of the body in a direction that is angled with respect to the geometric centerline of the body.

17. A golf club head comprising:

a face having a ball striking surface and being defined by a peripheral edge;

a body connected to the face and extending rearward from the face to define an enclosed volume, the body having a front side, a rear side, a heel side, a toe side, a crown, and a sole;

a first channel located on a surface of the body, the first channel having a periphery defined by boundary edges, wherein the boundary edges include a front edge extending laterally along the peripheral edge of the face between a heel end and a toe end of the first channel, such that the heel end and the toe end are located on opposite sides of a geometric centerline of the body, and the boundary edges further include a rear edge located further rearwardly than the front edge, wherein the first channel has a width measured in a front-to-rear direction between the front and rear edges; and a toe channel located on the surface of the body, the toe channel having a third periphery defined by third boundary edges, wherein the toe channel is located between the toe side of the body and the geometric centerline of the body, wherein the boundary edges of the first channel and the third boundary edges of the toe channel are disconnected and separated from each other by a toe spacing portion separating the first channel from the toe channel, wherein the rear edge includes a heel portion extending toward the front edge and toward the heel side of the body at a first angle to the front edge, such that the width of the first channel tapers to a first point at the heel end of the first channel, and the rear edge further includes a toe portion extending toward the front edge and toward the toe side of the body at a second angle to the front edge, such that the width of the first channel tapers to a second point at the toe end of the first channel, and wherein the toe spacing portion extends toward the face and toward the toe side of the body in a direction that is angled with respect to the geometric centerline of the body.

* * * * *